US006155677A

United States Patent [19]

Kitani et al.

[11] Patent Number: 6,155,677

[45] **Date of Patent: *Dec. 5, 2000**

[54] INK JET RECORDING HEAD, AN INK JET UNIT AND AN INK JET APPARATUS USING SAID RECORDING HEAD

[75] Inventors: Masashi Kitani, Yokohama; Hiroshi Sugitani, Machida; Yasuro Kashima, Fukushima; Masanori Takenouchi, Yokohama; Tadanobu Nagami, Machida; Kunihiko Maeoka, Kawasaki; Nobuyuki Sato, Yokohama; Hajime Yamamoto, Yokohama; Susumu Ito, Yokohama; Minoru Nozawa, Yokohama; Akira Tsujimoto, Yokohama; Seiichiro Karita, Yokohama; Masashi Miyagawa, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/346,917

[22] Filed: Nov. 23, 1994

[30] Foreign Application Priority Data

| | | | |
|---|---|---|---|
| Nov. 26, 1993 | [JP] | Japan | 5-296219 |
| Nov. 26, 1993 | [JP] | Japan | 5-296222 |
| Dec. 6, 1993 | [JP] | Japan | 5-305185 |
| Dec. 6, 1993 | [JP] | Japan | 5-305186 |
| Dec. 6, 1993 | [JP] | Japan | 5-305187 |
| Jul. 28, 1994 | [JP] | Japan | 6-177154 |
| Jul. 29, 1994 | [JP] | Japan | 6-178927 |
| Aug. 24, 1994 | [JP] | Japan | 6-199808 |

[51] Int. Cl.[7] ..... B41J 2/015; B41J 2/05

[52] U.S. Cl. ..... 347/65; 347/20

[58] Field of Search ..... 347/43, 65, 63, 347/67, 87

[56] References Cited

U.S. PATENT DOCUMENTS

| | | | |
|---|---|---|---|
| 4,224,627 | 9/1980 | Powell et al. | 347/47 |
| 4,412,224 | 10/1983 | Sugitani | 347/65 |
| 4,417,251 | 11/1983 | Sugitani | 347/65 |
| 4,437,100 | 3/1984 | Sugitani et al. | 347/65 |
| 4,509,063 | 4/1985 | Sugitani et al. | 347/65 |
| 4,521,787 | 6/1985 | Yokota et al. | 347/65 |
| 4,543,590 | 9/1985 | Tazaki et al. | 347/43 |

(List continued on next page.)

FOREIGN PATENT DOCUMENTS

| | | |
|---|---|---|
| 0322228 | 6/1989 | European Pat. Off. . |
| 0528440 | 2/1993 | European Pat. Off. . |
| 0538842 | 4/1993 | European Pat. Off. . |
| 55-118873 | 9/1980 | Japan . |
| 57-93163 | 6/1982 | Japan . |

(List continued on next page.)

*Primary Examiner*—N. Le
*Assistant Examiner*—L. Anderson
*Attorney, Agent, or Firm*—Fitzpatrick, Cella, Harper & Scinto

[57] ABSTRACT

An ink jet head for performing recording by discharging inks comprises an element substrate provided with a plurality of discharge energy generating elements for discharging the inks and a grooved member integrally having discharge ports, a plurality of grooves constituting ink flow passages provided corresponding to the discharge energy generating elements, a plurality of recess portions constituting a plurality of liquid chambers for supplying the inks to a plurality of ink flow passages, and separation grooves provided between the plurality of recess portions to separate between the recess portions constituting the liquid chambers. The element substrate and the groove member being jointed together. The liquid chambers are separated by the separation grooves for preventing the inks from flowing between the liquid chambers.

35 Claims, 22 Drawing Sheets

U.S. PATENT DOCUMENTS

| | | | |
|---|---|---|---|
| 4,558,333 | 12/1985 | Sugitani et al. | 347/65 |
| 4,609,427 | 9/1986 | Inamoto et al. | 216/27 |
| 4,611,219 | 9/1986 | Sugitani et al. | 347/40 |
| 4,666,823 | 5/1987 | Yokoto et al. | 430/320 |
| 4,914,736 | 4/1990 | Matsuda | 347/43 |
| 5,017,947 | 5/1991 | Masuda | 347/65 |
| 5,095,321 | 3/1992 | Saito et al. | 347/63 |
| 5,126,768 | 6/1992 | Nozawa et al. | 347/65 |
| 5,332,466 | 7/1994 | Nozawa | 216/27 |

FOREIGN PATENT DOCUMENTS

| | | |
|---|---|---|
| 1-234255 | 9/1989 | Japan . |
| 2-88247 | 3/1990 | Japan . |
| 5-212876 | 8/1993 | Japan . |
| 6-198898 | 7/1994 | Japan . |

230
220
240
170
140
130
100
250
300

180
113
150
180
113
150
180
113
180
150
160
130
260
170
170
260
260
170
250

360
370
440
420
430
400
390

300
100
310

INK JET RECORDING HEAD, AN INK JET UNIT AND AN INK JET APPARATUS USING SAID RECORDING HEAD

BACKGROUND OF THE INVENTION

1. Field of the Invention

The present invention relates to an ink jet recording head, an ink jet head unit and an ink jet apparatus, the ink jet recording head and the ink jet head unit being for use with the ink jet apparatus which performs the recording by discharging the liquid (e.g., ink) for recording as tiny liquid droplets through discharge ports to attach onto the recording medium, and more particularly to an ink jet head, an ink jet head unit and an ink jet recording apparatus for the color printing. The term "recording" for use with the present invention includes the printing onto cloth or plastics.

2. Related Background Art

A conventional ink jet recording head is comprised of a ceiling plate (grooved member) 1120 having a plurality of discharge ports 1105 for discharging the ink, a recess portion 1118 which is a common liquid chamber for holding the ink to be supplied to discharge ports 1105, and ink flow passages 1106 for communicating the common liquid chamber to discharge ports 1105, and a silicon substrate 1119 on which electrothermal converters (not shown) for supplying discharge energy to the ink within ink flow passages 1106 are formed corresponding to the ink flow passages 1106, the silicon substrate being joined with the ceiling plate, as shown in FIG. 37 (a perspective view as looked from the opposite side of the discharge ports) and FIG. 38 (a perspective view of the ceiling plate as looked from the side of its junction face with the substrate). Also, the silicon substrate 1119 has a drive circuit for driving the electrothermal converters incorporated therein, this drive circuit being electrically connected to wire bonding pads 1122 formed at the end portion of the silicon substrate 1119. And the silicon substrate 1119 is bonded by thermally conductive adhesive with an aluminum plate 1121 for releasing the heat from the silicon substrate 1119. The aluminum plate 1121 has a wiring substrate 1125 secured thereto, which relays the signal between the drive circuit and the ink jet recording apparatus, the terminals of the wiring substrate 1125 and the wire bonding pads 1122 of the silicon substrate 1119 being electrically connected through bonding wires (external wires) 1123.

On the other hand, in making the color printing, an ink jet unit 1150 having an arrangement of a plurality of ink jet recording heads 1151 for discharging the inks of different colors is used, as shown in FIG. 39. However, in this case, the size of the apparatus 1is difficult to reduce because of the employment of the plurality of ink jet recording heads 1151, and the cost of the apparatus will be increased by the amount corresponding to the number of ink jet recording heads 1151, although the apparatus has the advantage of the fast printing.

To resolve the above-mentioned problem, the inventors have attempted to create a small and inexpensive ink jet head in such a way as to use a pressing force of a spring to force a grooved member having recess portions corresponding to a plurality of liquid chambers into contact with an element substrate having a plurality of electrothermal converters.

However, in the case of such ink jet recording head, because a separation wall (liquid chamber wall) for separating between each liquid chamber is formed integrally with the grooved ceiling plate, it is apprehended that a gap may arise between the grooved ceiling plate and the substrate in a portion of this separation wall, as above described, so that owing to this gap, the ink within each liquid chamber may permeate or diffuse, in which there is a risk of producing the color mixture of inks, with the degraded quality of the recorded image.

It is conceived that a sealant is provided in the gap between this separation wall and the element substrate like the external periphery of a junction portion between the substrate and the grooved ceiling plate, but too much sealant may overflow into adjacent flow passages, or too little of sealant can not make the sealing of the separation wall portion completely, whereby the amount of sealant is difficult to control, and the separation between adjacent liquid chambers could not be securely made.

SUMMARY OF THE INVENTION

It is an object of the present invention to provide a small and inexpensive ink jet recording head which will produce no color mixture of inks, an ink jet unit using this ink jet recording head, and an ink jet recording apparatus.

To accomplish such object, the ink jet head of the invention is mainly constituted of an element substrate provided with a plurality of discharge energy generating elements for discharging the inks, and a grooved member integrally having discharge ports, a plurality of grooves making up ink flow passages provided corresponding to said discharge energy generating elements, a plurality of recess portions making up a plurality of liquid chambers for supplying the inks to a plurality of ink flow passages, and separation grooves provided between the plurality of recess portions to separate between said recess portions making up said liquid chambers, the grooved member and the element substrate being jointed together, said liquid chambers being separated by said separation grooves for preventing the ink from flowing between liquid chambers.

Or it comprises an element substrate provided with a plurality of discharge energy generating elements for discharging the inks, a plurality of liquid chambers provided on said element substrate, and groups of ink flow passages communicating correspondingly to said respective liquid chambers, ink flow passage separation grooves for preventing the inks from flowing between liquid chambers and corresponding groups of ink flow passages.

Also, to accomplish the above object, the ink jet unit is mainly constituted of any of the above-described ink jet recording heads, and an ink tank for holding the inks to be supplied to this recording head.

Also, to accomplish the above object, the ink jet recording apparatus mainly comprises any of the above-described recording heads and means for conveying the recording medium for receiving the inks discharged from said recording head.

Or it comprises any of the above-described ink jet recording heads and drive signal supply means for driving said recording head.

DETAILED DESCRIPTION OF THE PREFERRED EMBODIMENTS

The embodiment of the present invention will be described below with reference to the drawings.

<EXAMPLE 1>

Figure 1:
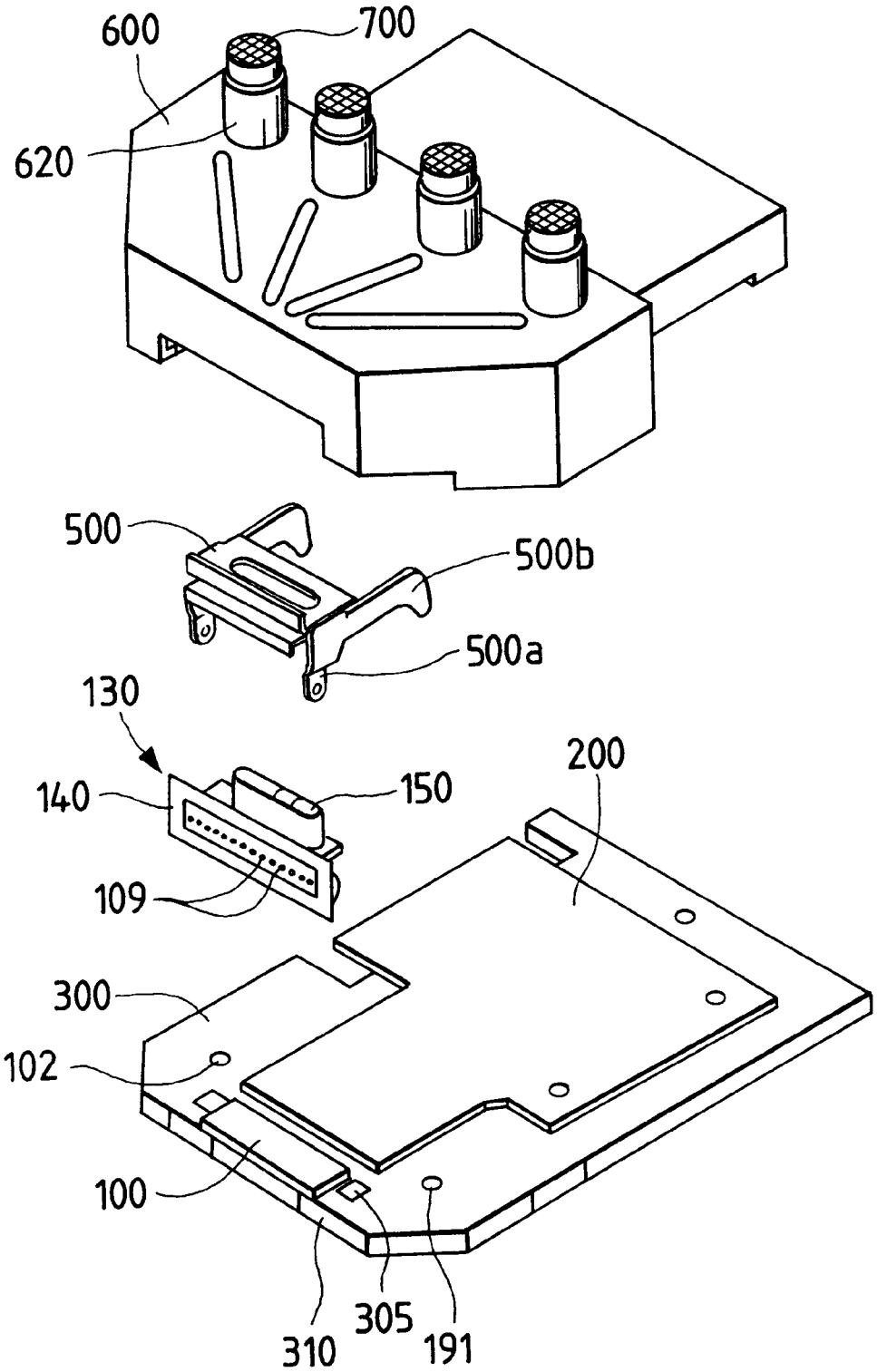
FIG. 1 is an exploded perspective view showing the constitution of an ink jet recording head of the present invention.

FIG. 1 is an exploded perspective view showing the constitution of an ink jet recording head of example 1 of the present invention.

An element substrate (heater board) 100 has a plurality of energy generating elements (electrothermal converters, not shown) provided for ink flow passages arranged on the surface, and typically is formed by applying the semiconductor manufacturing technologies to a silicon substrate. The wiring portion (not shown) conducting to the electrothermal converters is formed on the element substrate 100. A wiring substrate 200 is connected at one end thereof to the wiring portion of the element substrate 100 by bonding wire (not shown), and further is provided with a plurality of pads (not shown) for receiving electrical signals from a main device of an ink jet recording apparatus at the other end of the wiring substrate 200. With such a constitution, an electrical signal from the main device is supplied to each electrothermal converter.

Figure 2:
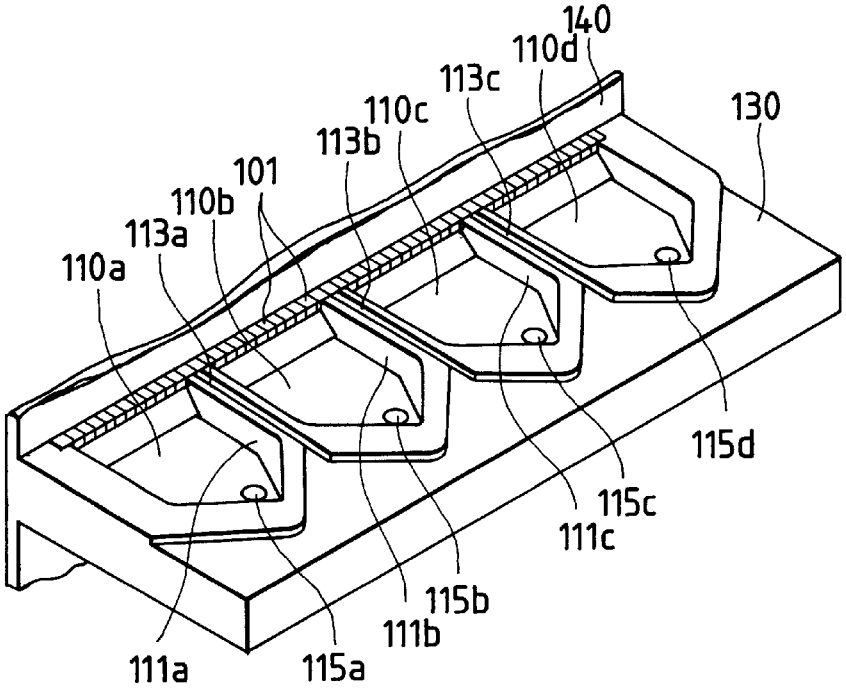
FIG. 2 is a perspective view of a grooved ceiling plate as viewed from the substrate side.

This ink jet recording head is provided with fine discharge ports for discharging the ink, ink flow passages communicating to discharge ports, and a plurality of liquid chambers (four liquid chambers in this example) for supplying the ink to ink flow passages. The liquid chambers are independent of each other and correspond to a plurality of discharge ports. Specifically, a number of grooves 101 corresponding to each of ink flow passages, recess portions 110*a* to 110*d* corresponding to each liquid chamber, and an orifice plate 140 making up a discharge port face are formed integrally as a grooved ceiling plate (grooved member) 130, which is then pressed against the element substrate 100, to complete the ink flow passages and the liquid chambers, as shown in FIG. 2. The orifice plate 140 is provided with discharge ports 109, each discharge port 109 communicating to grooves 101. The recess portions 110*a* to 110*d* are partitioned by walls 111*a* to 111*c*, respectively. The upper face of walls 111*a* to 111*c* as shown, that is, the pressing surface against the heater board 100 is impressed with a separation groove 113*a* to 113*c*. Each separation groove 113*a* to 113*c* extends to the external periphery of the grooved ceiling plate 130. Further, the bottom portion of recess portion 110*a* to 110*d* as shown is formed with a supply opening 115*a* to 115*d* for supplying the ink to a corresponding liquid chamber. The material of grooved ceiling plate 130 is polysulfone, for example.

A support 300 made of metal which supports the back face of the element substrate 100 and that of the wiring substrate 200 on its plane is a bottom plate of this ink jet recording head. A presser spring 500 for pressing the grooved ceiling plate 130 against the element substrate 100 is provided. The presser spring 500 has a bent portion of substantially U-character shape in cross section for exerting a pressure in linear and elastic manner to an area near the discharge ports 109 of the grooved ceiling plate 130, pawls 500*a* for engaging into escape holes 305 provided on the support 300, and a pair of rear legs 500*b* for receiving a force acting on the spring with the support 300. Also, at the top end of the support 300 on the discharge ports face side are formed grooves 310. The attachment of the wiring substrate 200 onto the support 300 is achieved by bonding such as adhesive.

An ink supply member 600 for supplying the ink to the recess portions 110*a* to 110*d* (common liquid chamber) of the grooved ceiling plate 130 is provided. Within the ink supply member 600, four ink supply tubes 620 communicating to respective supply openings 115*a* to 115*d* are provided, with a filter 700 provided at the end portion of each ink supply tube 620. The securement of the ink supply member 600 can be simply performed by fitting the ink supply member 600 over a projection 150 on the side of supply openings 115*a* to 115*d* of the grooved ceiling plate 130, and extending two pins (not shown) on the back face side of the ink supply member 600 into and throughout holes 191, 192, followed by thermal fusion.

Figure 3:
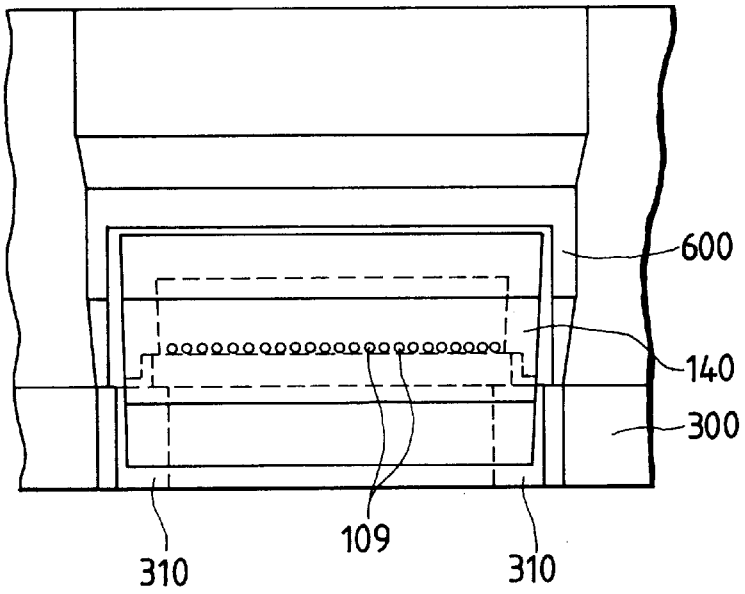
FIG. 3 is a schematic view of the ink jet recording head of FIG. 1 as viewed from the orifice plate side.
Figure 4:
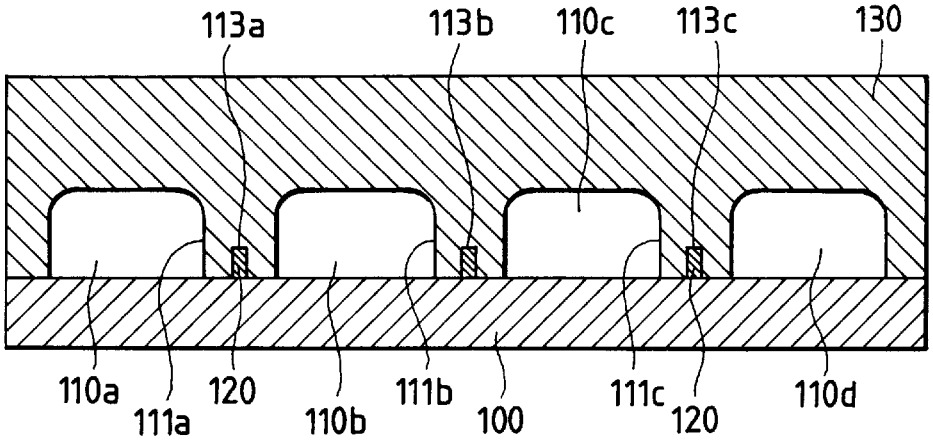
FIG. 4 is a cross-sectional view of the essence of an ink jet recording head.

The attachment of the ink supply member 600 is achieved after pressing the grooved ceiling plate 130 against the heater board (element substrate) by the pressing spring 500, and in doing so, care must be taken to form an even gap between an orifice plate portion 140 of the grooved ceiling plate 130 and the ink supply member 600. And a sealant is poured though a sealant inlet opening (not shown) provided above the ink supply member 600 to seal the bonding wire, as well as a gap between the orifice plate portion 140 and the ink supply member 600, and further completely seal a gap between the orifice plate portion 140 and a front end face of the support 300 through the grooves 310 provided on the support 300. Then, the sealant 120 will permeate along separation grooves 113*a* to 113*c*, thereby filling the gap between the grooved ceiling plate 130 and the element substrate 100. This allows not only the control of the amount of sealant to be made easier, but also the improved adherence of the substrate with the grooved ceiling plate to be attained, whereby the separation between liquid chambers can be attained more securely, with liquid chambers supplied with different inks, while preventing the inks from mixing in performing the color recording of using the multiple colors. The sealing within the separation grooves is preferably made as completely as possible, but a space may be permitted as far as the ink mixture is not produced. FIG. 3 is a front view of an ink jet recording head as viewed from the side of the orifice plate portion 140, and FIG. 4 is a cross-sectional view of a liquid chamber portion as cut in the vertical direction to the ink flow passage.

In this example, as a sealant having adhesive power to polysulfone and capable of sealing by wire bonding, TSE399 (trade name) made by Toshiba Silicone was used. Also, each separation groove 113*a* to 113*c* had approximate dimensions 2 mm long, 0.2 mm wide and high. This construction of separation grooves is appropriately changed according to the used sealant or the material of ceiling plate member or the purposes.

<EXAMPLE 2>

Figure 5:
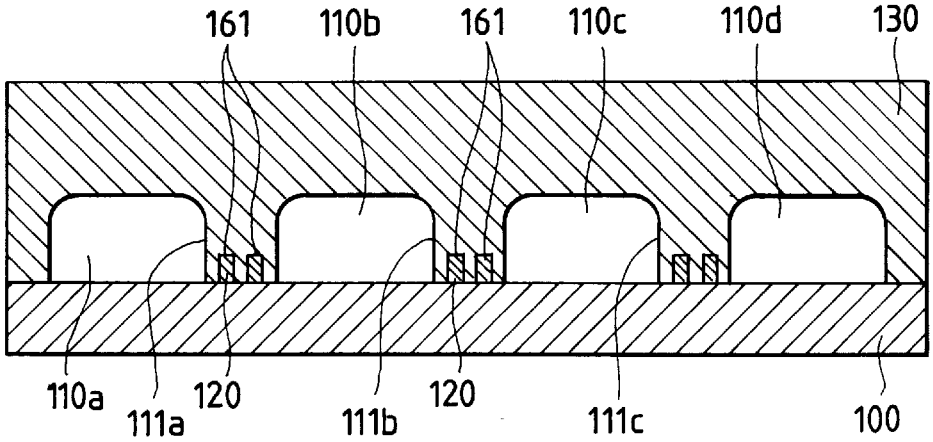
FIG. 5 is a cross-sectional view of the essence of an ink jet recording head.

For example, the number of separation grooves provided on the walls between adjacent recess portions in the grooved ceiling plate 130 is not limited to one for each wall, but as shown in FIG. 5, two separation grooves 161 are provided for each wall 111*a* to 111*c* in the grooved ceiling plate 130, with a sealant 120 permeated inside each separation groove 161. In this case, the sealant in the separation wall portion has the improved adherence, and the improved reliability over the long term, as compared with example 1.

<EXAMPLE 3>

Figure 6:
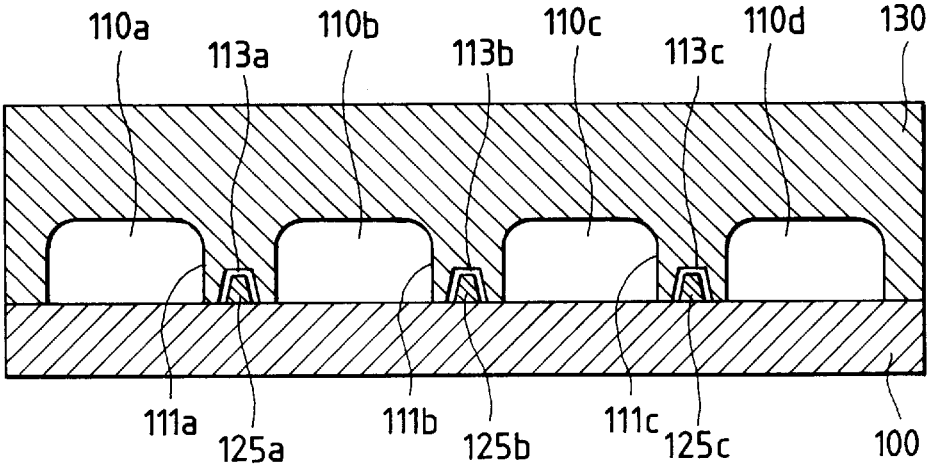
FIG. 6 is a cross-sectional view of the essence of an ink jet recording head.

Further, as shown in FIG. 6, ribs 125*a* to 125*c* are formed on the element substrate 100 corresponding to separation grooves 113*a* to 113*c* provided on the walls 111*a* to 111*c* of the grooved ceiling plate 130. The ribs 125*a* to 125*c* can be preferably made of photosensitive resin. It is possible to introduce the sealant into the separation grooves with the ribs provided, but by fitting the ribs 125*a* to 125*c* with the separation walls 113*a* to 113*c*, it is possible to prevent the ink from each liquid chamber from permeating or diffusing without introducing the sealant, whereby the separation between each liquid chamber becomes complete to resolve the problem of color mixture which may occur upon the color recording of using the inks of multiple colors. Furthermore, with these ribs, the positioning of the substrate with the grooved ceiling plate can be securely made.

As described in the above examples, a separation groove communication to the external periphery is provided on each wall-like portion for separating between recess portions corresponding to liquid chambers in a first member (grooved ceiling plate). By pouring the sealant into the separation grooves after pressing the first member and a second member together, or providing the ribs to be fitted into the separation grooves on the second member, the ink is prevented from permeating or diffusing between liquid chambers, which is effective to make the separation between liquid chambers complete. Thereby, in performing the color recording using the inks of multiple colors, the color mixture of inks can be prevented to reproduce the vivid color of each ink, which is effective to make the high quality recording.

<EXAMPLE 4>

Figure 7:
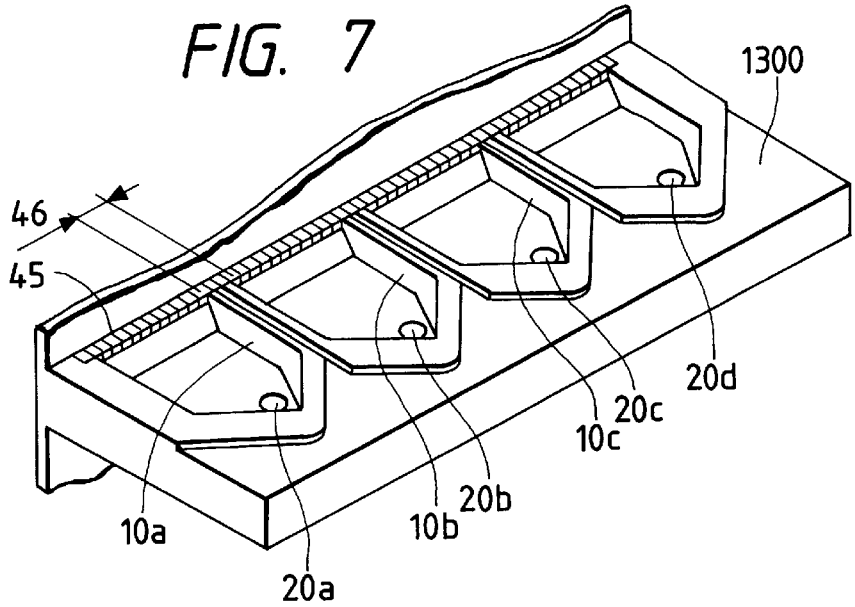
FIG. 7 is a perspective view of an example of a grooved member.

FIG. 7 is a perspective view of a grooved ceiling plate 1300 of the present invention as viewed from the side of a heater board (element substrate) 100. A plurality of liquid chambers (four chambers in the same figure) are provided, with the liquid chambers being partitioned by the walls 10*a* to 10*c*. Each liquid chamber is provided with a supply opening 20*a* to 20*d* for supplying the ink. The flow passages 45 leading to discharge ports are formed at an equal pitch over the entire area of a ceiling plate. A gap 46 between adjacent liquid chambers is formed in a dimension of an integral number times the pitch of flow passage.

By forming a plurality of liquid chambers separately, different inks can be supplied to respective chambers, using one ink jet head unit to make the color printing, whereby the ink jet head unit can be fabricated in more compact form. In particular, by having the gap between divided liquid chambers to be an integral number times the pitch of flow passage, the number of flow passages for each liquid chamber can be changed if the separating position is changed. Also, since the gap between each liquid chamber is an integral number times the pitch of flow passage, the plurality of liquid chambers can be arranged near the ink flow passages, while maintaining the pitch of discharge ports of four colors at the recording. Therefore, the size of head can be reduced.

<EXAMPLE 5>

In the following example, the sealing of separation grooves as described in the previous example is improved to have a higher throughput.

Figure 8:
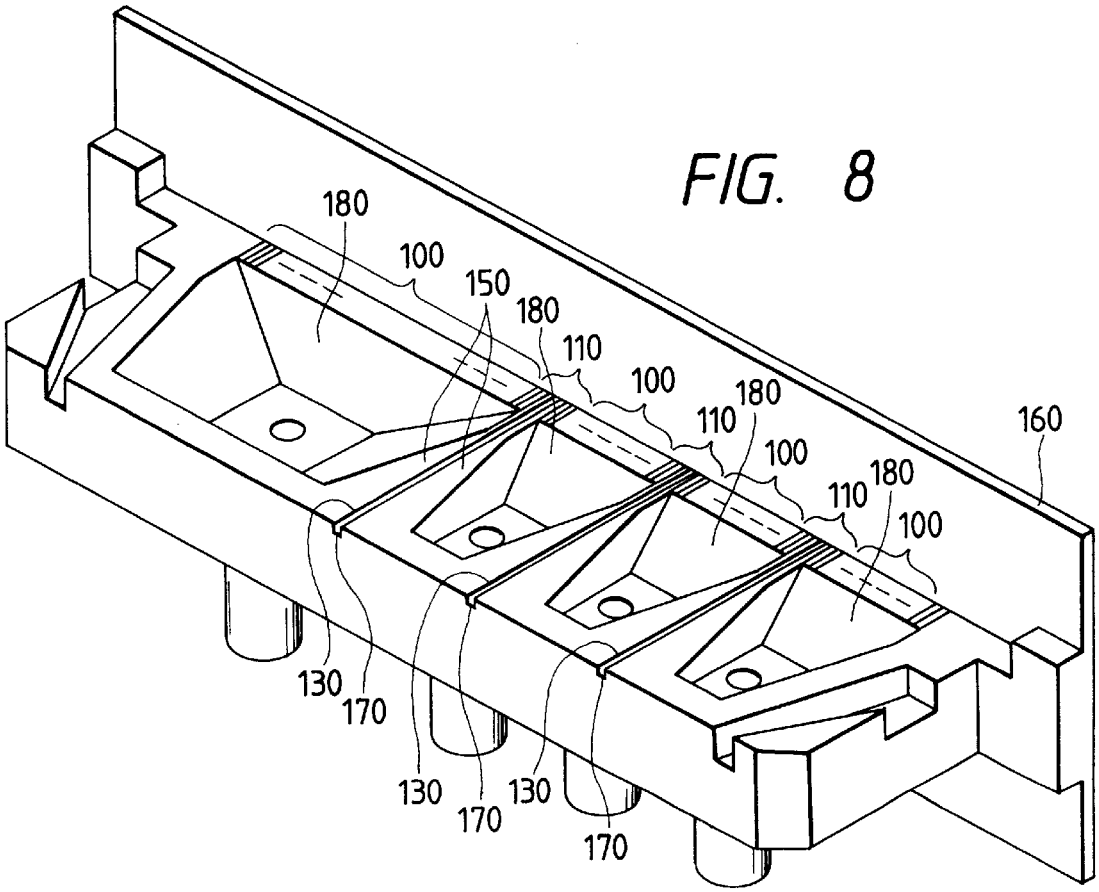
FIG. 8 is a perspective view of an example of a grooved member.
Figure 9:
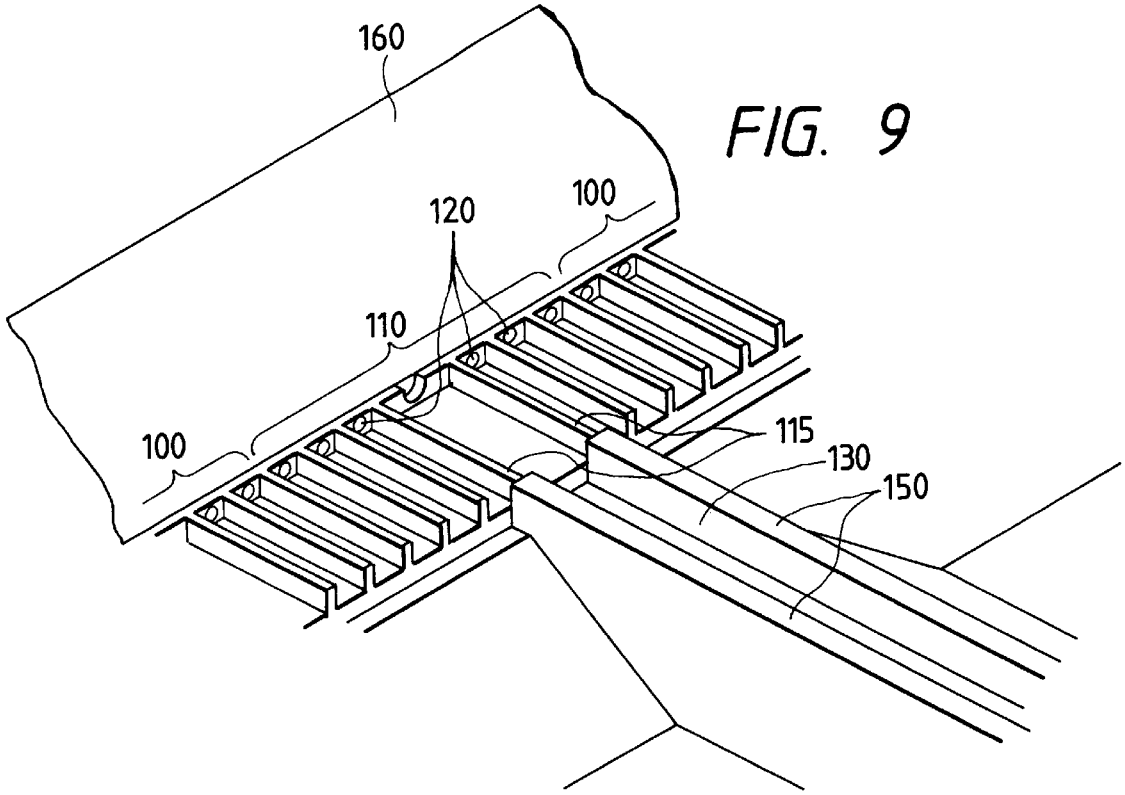
FIG. 9 is an enlarged view of a plurality of liquid chamber separation grooves in the nozzle portion of a grooved ceiling plate.
Figure 10:
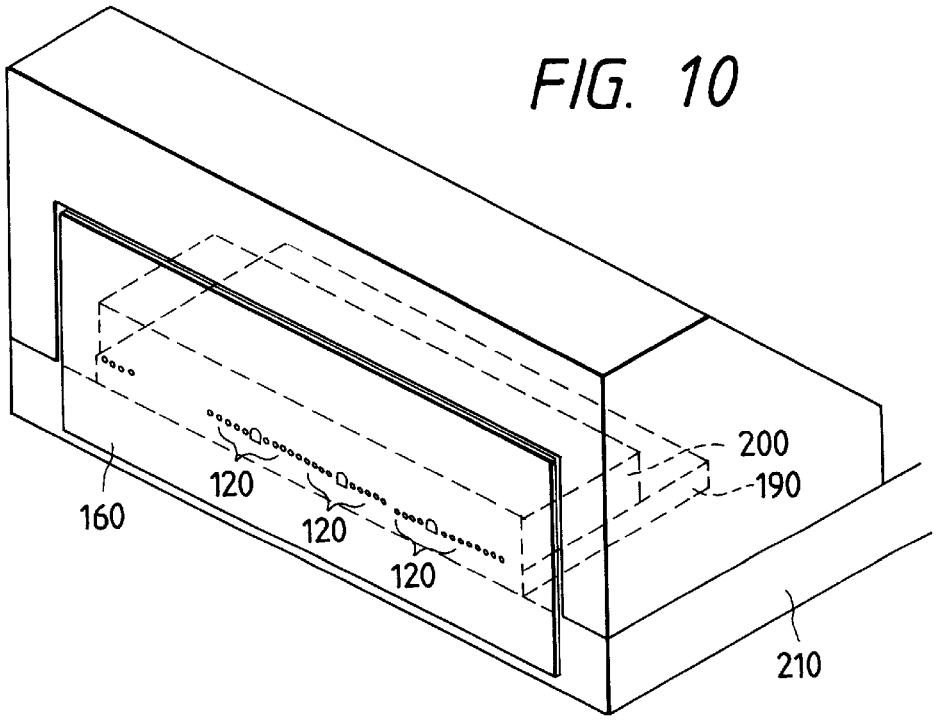
FIG. 10 is a constitutional view of an example of an ink jet recording head.

FIG. 8 is a perspective view showing a grooved ceiling plate in the fifth example of the invention, FIG. 9 is an enlarged view of a plurality of liquid chamber separation grooves in the nozzle portion of the grooved ceiling plate as shown in FIG. 8, and FIG. 10 is a perspective view of an ink jet recording head according to the fifth example.

The ink jet recording head of this example is of four colors integrally provided. In FIG. 8, 100 designates ink discharge nozzles, 110 a plurality of liquid chamber separation grooves having only nozzle portions formed therein and provided as the dummy nozzle, 130 a common liquid chamber separation groove, 150 a common liquid chamber separation groove wall, 160 an orifice plate, 170 a sealant inlet opening into the common liquid chamber separation groove 130, and 180 a common liquid chamber for storing each color of ink with four common liquid chambers provided.

In FIG. 9, the liquid chamber separation groove 110, which is comprised of a plurality of separation grooves, has the width corresponding to two ink discharge nozzles 100, including separation grooves leading to the common liquid chamber separation groove 130 and separation grooves disposed with the same width and interval as those of ink discharge nozzles 100 which are provided three on either side thereof, the total number of dummy nozzles being seven. 120 is a hole opened in the orifice plate 160 corresponding to each of separation grooves constituting the liquid chamber separation groove 110.

In FIG. 10, 200 is a grooved ceiling plate, and 190 is a silicon substrate with electrothermal converters and a drive circuit incorporated therein, which is joined with the grooved ceiling plate 200. 210 is an aluminum plate for releasing the heat from the silicon substrate 190. Also, the silicon substrate 190 is bonded by thermal conductive adhesive to the aluminum plate 210.

When the sealant is poured into the liquid chamber separation groove 110 between liquid chambers of the ink jet head, the sealant is applied on the silicon substrate 190 through the sealant inlet opening 170 at the back end of the ceiling plate 200 by means of a dispenser. The applied sealant is poured into the common liquid chamber separation groove 130 due to capillary force, coming to a central liquid chamber separation groove which is widest among the plurality of liquid separation grooves 110 formed.

When a sealing resin is poured from the common liquid chamber separation groove 130 into the liquid chamber separation grooves 110, the sealing resin is first poured into only the central separation groove. If the sealant is filled in the central separation groove and overflows therefrom, overflowing sealant passes into adjacent separation grooves, so that the sealant is flowed successively into each separation groove located outwards of the central separation groove.

Further, the sealant coming to through-holes at the top end of separation grooves is filled into the gap between the orifice plate near the separation grooves and the silicon substrate.

The required amount of sealant is the amount for filling all the separation grooves, except for separation grooves adjacent to the ink discharge nozzles 100, that is, in this example, the amount for filling five separation grooves including the central separation groove, and the gap between the orifice plate near the separation grooves and the silicon substrate.

In pouring the sealant into the liquid chamber separation grooves, a hole 120 is opened in a portion of the orifice plate 160 corresponding to each liquid chamber separation groove 110 in this example, to allow the air remaining inside to escape, thereby facilitating the sealant to come to the orifice plate 160. The sealant poured into each separation groove of the liquid chamber separation groove 110 is stopped due to surface tension of the hole 120 of the orifice plate 160.

In this example, the liquid chamber separation groove 110 is divided into a plurality of separation grooves, with separation grooves adjacent to the ink discharge nozzles 100 being filled with no sealant. Therefore, even if the filling amount of sealant is less than a predetermined amount, the sealant can be securely poured into some of a plurality of separation grooves. Also, when the filling amount of sealant is greater than the predetermined amount, the amount of sealant which was conventionally required to regulate to the least value can be poured readily because more volume of separation grooves into which the sealant essentially should not be poured will be allowed, whereby the separation between liquid chambers is made securely and the yield is improved.

<EXAMPLE 6>

Figure 11:
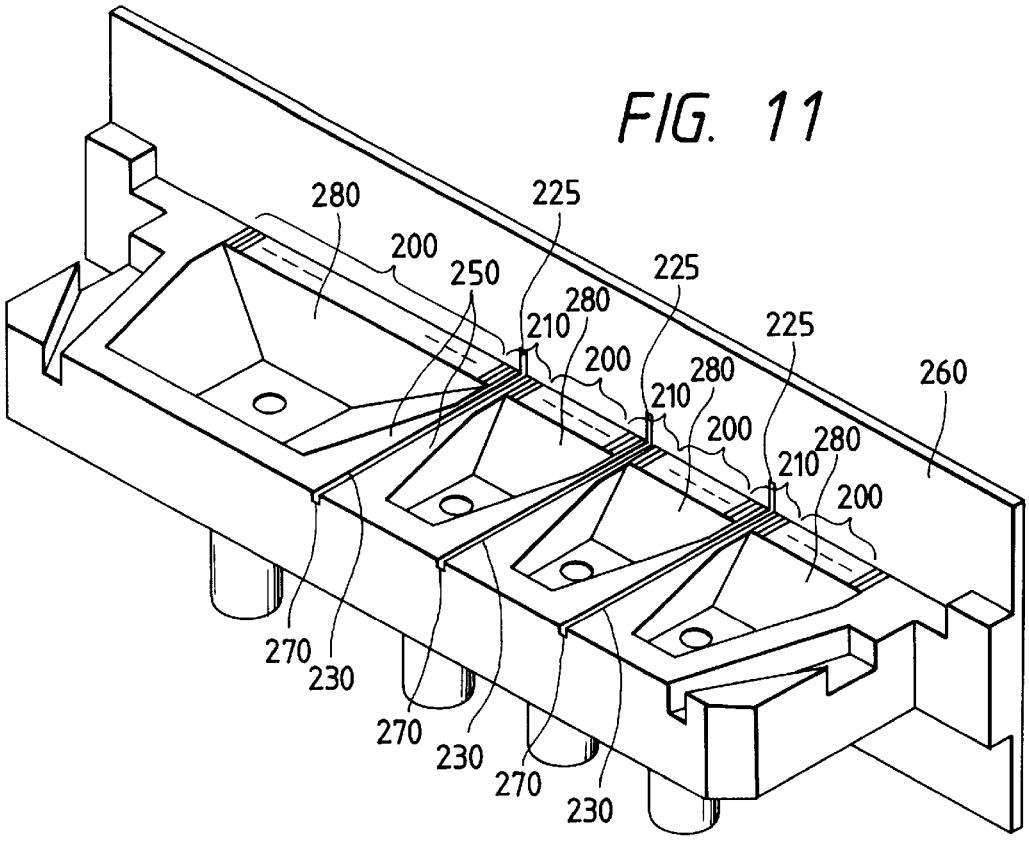
FIG. 11 is a typical view of a grooved ceiling plate.
Figure 12:
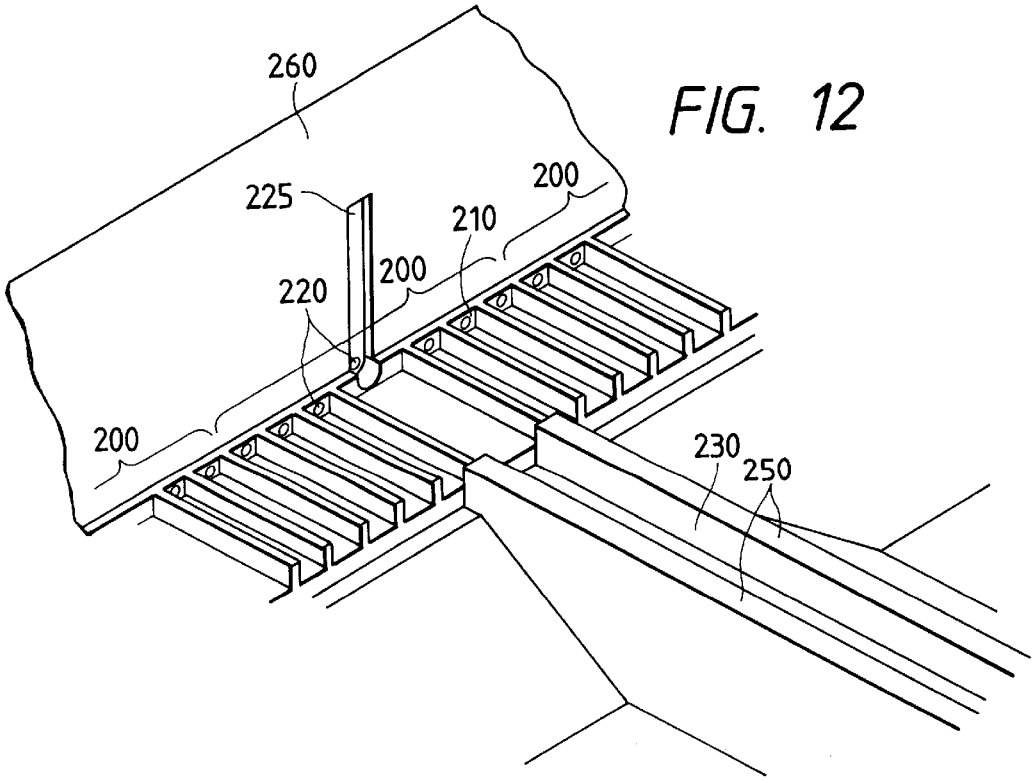
FIG. 12 is an enlarged view of liquid chamber separation grooves in the nozzle portion of the grooved ceiling plate as shown in FIG. 11.
Figure 13:
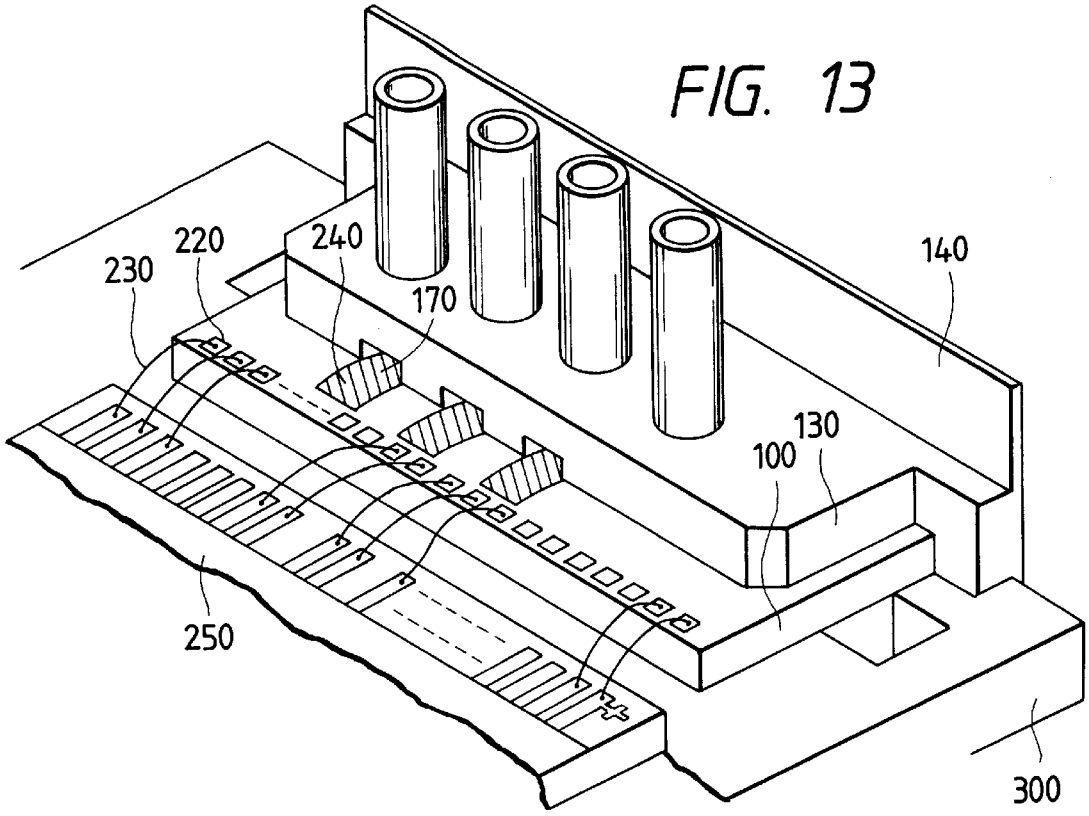
FIG. 13 is a perspective view of an ink jet recording head of the invention, as viewed from the rear side.

FIG. 11 is a perspective view showing a grooved ceiling plate in the sixth example of the invention, FIG. 12 is an enlarged view of a plurality of liquid chamber separation grooves in the nozzle portion of the grooved ceiling plate as shown in FIG. 11, and FIG. 13 is a perspective view of an ink jet recording head according to the sixth example.

In FIG. 11, 200 represents ink discharge nozzles, 210 a plurality of liquid chamber separation grooves having only nozzle portions formed therein and provided as the dummy nozzle, 230 a common liquid chamber separation groove, 250 is a common liquid chamber separation groove wall, 260 an orifice plate, 270 a sealant inlet opening into the common liquid chamber separation groove 230, 280 a common liquid chamber, and 225 a groove provided on a portion of the orifice plate 260 corresponding to the common liquid chamber separation groove 230.

In FIG. 12, the liquid chamber separation groove 210, which is comprised of a plurality of separation grooves, has the width corresponding to two ink discharge nozzles 200, including separation grooves leading to the common liquid chamber separation groove 230 and separation grooves disposed with the same width and interval as those of ink discharge nozzles 200 which are provided three on either side thereof, the total number of dummy nozzles being seven. 220 is a hole opened in the orifice plate 260 corresponding to each of separation grooves constituting the liquid chamber separation groove 210. The groove 225 extends to the hole 220 opened in the centrally located separation groove which is widest among the separation grooves constituting the common liquid chamber separation groove 230.

In this example, the process of pouring the sealant into the liquid chamber separation grooves 210 is substantially the same as that of the previous example.

While in the previous example, the sealant was poured into the gap portion due to capillary force, it should be noted that the groove 225 may be provided on the plane of the orifice plate 260 facing the silicon substrate 190 leading to the hole 220 opened in the orifice plate 260 within the liquid chamber separation groove 210 to effect the filling more reliably. Thereby, the sealant passing through the liquid chamber separation groove 210 to the orifice plate 260 is poured more reliably into the gap between the orifice plate 260 and the silicon substrate 19 along the groove 225.

In the above examples 5 and 6, the following effects can be further provided.

As described above, according to the present invention, sealant filling grooves for separation are provided between common liquid chambers, the filling grooves arranged adjacent the ink discharge grooves comprise dummy grooves similar to the ink discharge grooves, serving as the walls for preventing excess sealant from flowing into the ink discharge grooves, with a through-hole opened in the orifice plate within and dummy groove, whereby the plurality of common liquid chambers in the ceiling plate can be separated securely with good yield without causing the sealing resin to flow into the ink discharge grooves.

Further, by providing a groove on the orifice plate opposite the silicon substrate underneath the through-hole opened in the orifice plate, the sealant can be poured more reliably between the silicon substrate and the orifice plate, which is effective to make the separation between liquid chambers more securely.

Next, there will be described an example for pouring the sealant easily and with good yield from a sealant inlet opening (the end portion of the separation groove opposite to the discharge port side) when the sealant is poured into the separation grooves as previously described.

<EXAMPLE 7>

FIG. 13 is a perspective view of the essence of an ink jet head in this example, as viewed from the side of wire bonding pads 220 in an opposite direction to the discharge port face on which the discharge ports are provided. The principal constitution is the same as those of previous examples, and is not described.

170 is a sealant inlet opening and 240 is a sealant application portion. 250 is a wiring substrate, bonding pads on the wiring substrate and bonding pads 220 on the element substrate 100 being connected through bonding wires 230.

Figure 14:
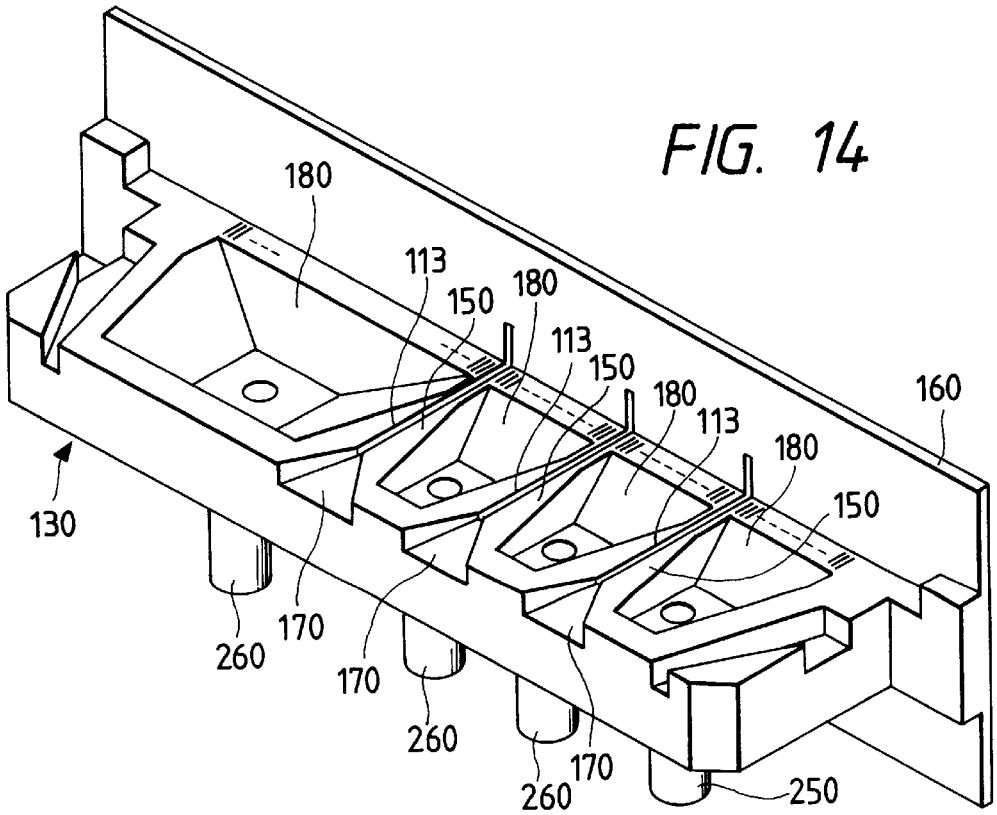
FIG. 14 is a typical view of a grooved ceiling plate.
Figure 15:
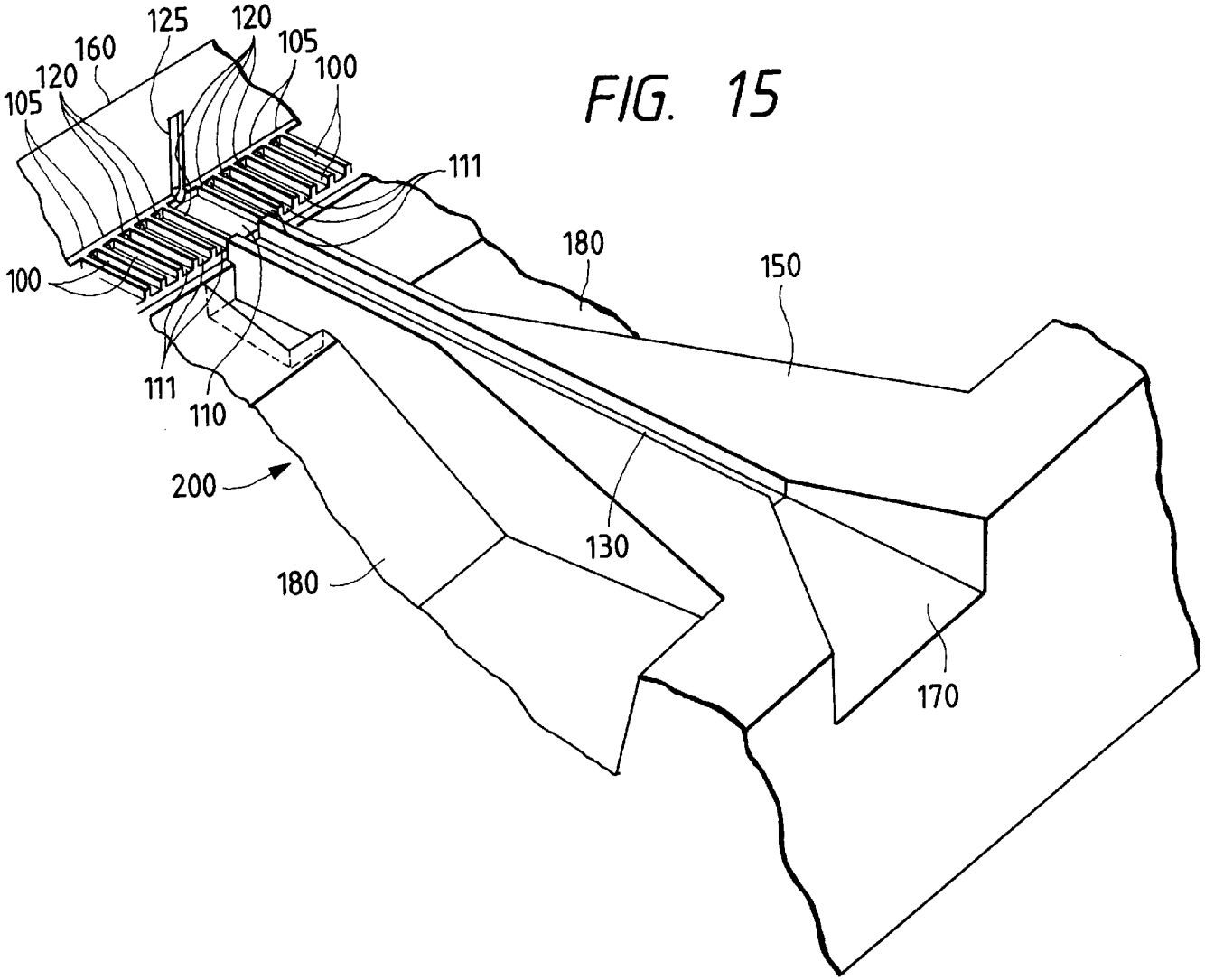
FIG. 15 is an enlarged perspective view around common liquid chamber separation walls of the grooved ceiling plate.

Herein, a ceiling plate 200 will be described below with reference to FIGS. 14 and 15. FIG. 14 is a perspective view of the ceiling plate 200 of the ink jet head as shown in FIG. 13 as viewed from the side of a junction face with the silicon substrate 190, and FIG. 15 is an enlarged perspective view of the ceiling plate 130 of FIG. 14 near the common liquid chamber separation wall.

As shown in FIG. 14, the ceiling plate 130 has an orifice plate 160 and four ink supply openings which are integrally formed, four recess portions 180 being formed through common liquid chamber separation walls 150. Each recess portion 180 serves as a common liquid chamber for holding the ink when the ceiling plate 200 is joined with a silicon substrate 190 (see FIG. 13), each common liquid chamber being supplied with the ink of color in the order of black, cyan, magenta and yellow from the left side in FIG. 14 through an ink supply opening 260. In this example, the black ink has the number of flow passages and the capacity of liquid chamber which are significantly different from other colors. Also, the orifice plate 160 is formed with a plurality of discharge ports 105, each of which is in communication with one of recess portions 180 through an ink flow passage 100 which is a groove, as shown in FIG. 15. An electrothermal converter as previously described is provided for each ink flow passage 100, and by driving the electrothermal converter based on a drive signal, the ink on the electrothermal converter is heated rapidly to produce a bubble within the ink flow passage, and the ink is discharged though the discharge port 105 by the growth of this bubble.

Further, when the ink flow passages 100 in communication with the same recess portion 180 are one group of ink flow passages, seven dummy nozzles 110, 111 similar to ink flow passages are formed between mutually adjacent ink flow passages, and among them, a central dummy nozzle 110 is wider than other dummy nozzles 111. The dummy holes 110, 111 are in communication with the outside through holes 120 formed in the orifice plate 160, and among such holes 120, a central hole 120 leads to a groove 125 formed in the orifice plate 160.

On the other hand, on a junction face of each common liquid chamber wall with the silicon substrate 190, a common liquid chamber separation groove 130 extending from one end (top end) of the orifice plate 160 to the other end (rear end) thereof is formed, the top end extending to the central dummy hole 110. Also, at the rear end of each common liquid chamber separation groove 130, a sealant inlet opening 170 is disposed for pouring a sealant for sealing the gap between each common liquid chamber after joining the ceiling plate 200 and the silicon substrate 190, its width being greater than the common liquid chamber separation groove 130. That is, the size of the sealant inlet opening 170 is greater than the cross section of the common liquid chamber separation groove 130.

When the sealant is poured on the basis of the above-described constitution, the sealant is applied on the sealant application portion 240 as shown in FIG. 13 (by the slanting line in the figure), i.e., the silicon substrate 190 rearwards of the sealant inlet opening 170 by using pouring means such as a dispenser. The sealant applied on the sealant application portion 240 will enter the common liquid chamber separation groove 130 due to capillary phenomenon, and further come to the central dummy nozzle 110. The sealant after filling the central dummy nozzle 110 will overflow from the central dummy nozzle 110, and enter the dummy nozzle 111 outwardly adjacent thereto from the back side. This operation is repeated successively to pour the sealant in the dummy nozzles 110, 111, until the gap between common liquid chambers is completely sealed. Herein, it is noted that by regulating the sealant to be applied to the sealant application portion 240 to an amount that the flow of sealant stops at the second dummy nozzle 111 from the outermost side, the sealant will only enter the outermost dummy nozzle 111 but will not enter ink flow passages 100, even if the sealant overflows from the dummy nozzles 111. Also, since each dummy nozzle 110, 111 is in communication with the outside through a respective hole 120, the sealant can be brought into the hole 120 by escaping the air inside each dummy nozzle 110, 111 when the sealant is poured into each dummy nozzle 110, 111. Then, the sealant is held on the surface of hole 120 due to surface tension. Further, since the groove 125 leading to the central hole 120 among the holes 120 is formed on the orifice plate 160, the sealant is also poured to the contact face between the silicon substrate 190 and the orifice plate 160 to seal that face.

The sealant used may be a silicone resin (TSE399 made by Toshiba Silicone) which is a hygroscopic curable resin, for example. Also, the amount of sealant necessary to seal the gap between common liquid chambers in practice is about 0.15 mm per common liquid chamber separation groove 130, and by providing a sealant inlet opening 170 which is wider than the common liquid chamber separation groove 130 as described above, the sealant inlet opening 170 acts as a bank for sealant, so that the amount of sealant applied on the sealant application portion 240 can be increased by the amount of capacity for the sealant inlet opening 170. If the amount of sealant applied increases up to, e.g., about 1 mg, the application amount of sealant can be controlled stably by means of a dispenser. Consequently, there are no cases that the sealing between common liquid chambers is insufficient due to too less amount of sealant, or the sealant overflows into the ink flow passages 100 due to too much amount of sealant, whereby the sealing between common liquid chambers can be securely made, and the yield in the manufacture of the ink jet head is improved. The capacity of the sealant inlet opening 170 can be set in accordance with the thickness of dispenser needle and the positioning precision of the dispenser.

<EXAMPLE 8>

Figure 16:
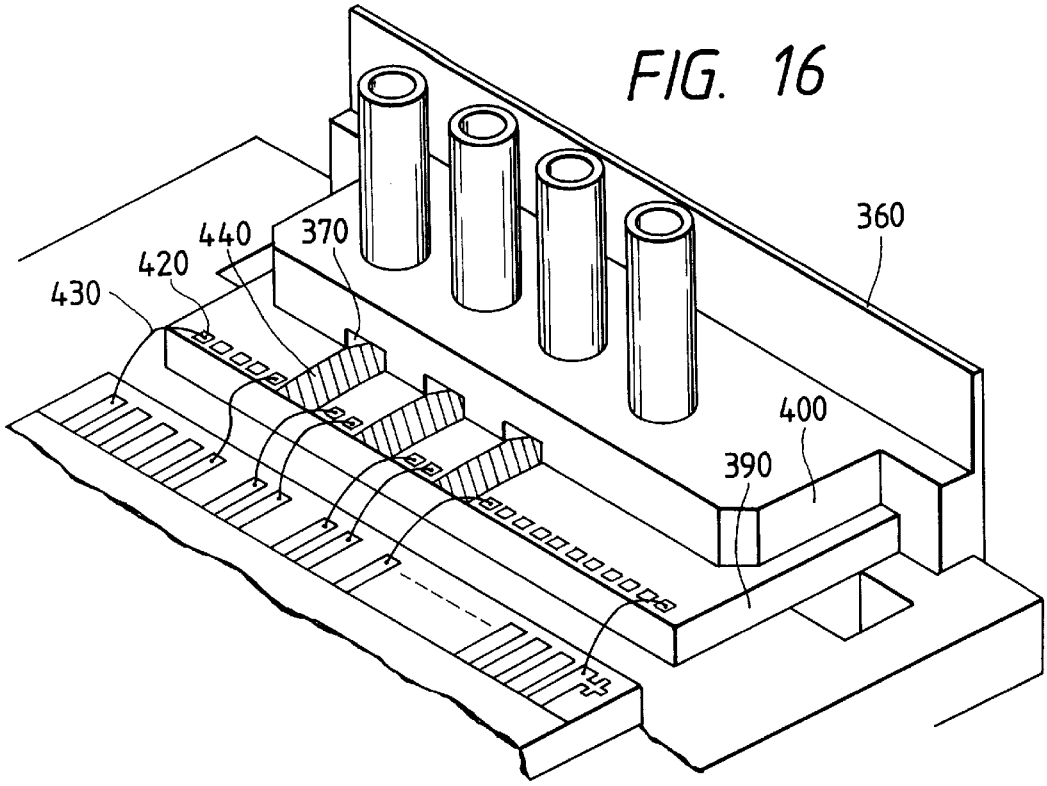
FIG. 16 is a view of an ink jet recording head of the invention, as viewed from the rear side.

FIG. 16 is a perspective view of the essence of an ink jet head according to the eighth example of the present invention. The ink jet head of this example has a sealant inlet opening 370 for pouring the sealant whose width is greater than that of a common liquid chamber separation groove (not shown), like the seventh example, but is different from the seventh example in that no wire bonding pad is formed in the area from the opening portion of each sealant inlet opening 370 to the rear end of a silicon substrate 390 (the opposite end of an orifice plate 360), this area being a sealant application portion 440. The remaining constitution is the same as the seventh example, and is not described.

When the sealant is applied on the sealant application portion 440 by means of a dispenser, it is necessary that the gap between a dispenser needle and a silicon substrate 390 be kept 0.1 to 0.2 mm to regulate the application amount stably. On the other hand, where wire bonding pads 420 are formed in the area from the sealant inlet opening 370 to the rear end of the silicon substrate 390, like the seventh example, if the used needle is a narrowest needle of 28 gauge, for example, with the thickness of the needle being 0.32 mm, supposing that the variation in the positioning precision of the needle is ±0.05 mm, and considering that the length of a wire bonding pad 420 is 0.2 mm, and the distance from the rear end of the silicon substrate 390 to the wire bonding pad 420 is 0.1 mm, it is necessary that the distance from the rear end of ceiling plate 400 to the rear end of the silicon substrate 390 is 0.72 mm at the shortest.

Thus, by arranging wire bonding pads 420 as in this example, the distance from the rear end of he ceiling plate 400 to the rear end of the silicon substrate 390 can be shortened by the amount of the length of wire bonding pad 420 which is equal to 0.2 mm, plus the distance from the rear end of the silicon substrate 390 to the wire bonding pads 420 which is equal to 0.1 mm, and thereby suffices to be at least 0.42 mm. Consequently, the silicon substrate 390 can be reduced in size, and the number of silicon substrates 390 to be taken from one wafer can be increased, whereby the wafer can be more effectively used. Also, since no bonding wires 430 interfere in applying the sealant, no hanging of the dispenser needle over the bonding wire 430 will occur, and the application of the sealant can be facilitated. As a result, the bonding wires 430 are prevented from cutting off so that the yield in the manufacture of the ink jet head is improved.

In practice, if the narrowest needle of 28 gauge is used for the dispenser needle, the amount of sealant issuing from the needle is least and it takes more time for pouring, in which it is preferable to use the needle of 25 gauge or greater. In this case, the distance from the rear end of the ceiling plate 400 to the rear end of the silicon substrate 390 is necessary to be at least 0.61 mm. The area where wire bonding pads 420 are not formed on the surface of the silicon substrate 390 is necessary to have a predetermined size not to interfere with the wire bonding pads in applying the sealant, in which it is no problem if the size of the sealant inlet opening 370 is greater than this area, because it is only needed to increase the application amount of sealant.

As described above, the ink jet recording head and the ink jet unit of the examples 7 and 8 have the ability of controlling stably the amount of sealant to be supplied to the sealant inlet opening in such a way as to construct the sealant inlet opening to be larger than the cross section of separation grooves at the end portion thereof opposite to the side where discharge ports are disposed, the separation grooves for separating between common liquid chambers having the sealant filled inside being disposed in the grooved member which is joined with the substrate. Consequently, the amount of sealant to be filled into the separation grooves is kept constant more easily, so that the sealing between common liquid chambers with the sealant can be made easily and securely.

Also, where the substrate is larger in size than the grooved member, and the terminals into which a drive signal for driving the energy generating elements is entered through the external wiring are provided on a region of the junction face of the substrate with the grooved member and out of contact with the grooved member, the sealant can be easily poured through the opening portion of the sealant inlet opening without the external wiring disturbing the pouring means, in such a way as to provide the terminal on the region except from the opening portion of the sealant inlet opening to the opposite end portion of the substrate where discharge ports are disposed. Also, in this case, owing to reduced size of the substrate, a less expensive ink jet head and ink jet head cartridge can be provided.

And an ink jet apparatus of the invention can discharge the inks in good condition, since the gap between common liquid chambers of the ink jet head is securely sealed with the sealant by comprising an ink jet head of the invention as above described. Also, the recording with a plurality of types of inks can be accomplished with one ink jet head so that a smaller ink jet apparatus can be constructed. This is particularly effective in making the color printing.

<EXAMPLE 9>

The head structure of this example is substantially the same as that of the previous examples.

However, it is to be noted that the inner wall of common liquid chamber separation groove has higher wettability due to the contact face of the separation wall with the substrate in this example.

To make such a constitution, it is necessary hat the inner wall of common liquid chamber separation groove is treated to be hydrophilic or the contact face of the separation wall with the substrate is treated to be water repellent.

When the sealant is poured into the separation groove between liquid chambers of the ink jet head in this example, the sealant is applied on the silicon substrate at the rear end of the sealant inlet opening of the grooved ceiling plate by means of a dispenser. The applied sealant is flowed into the separation groove between liquid chambers due to capillary force to come to the dummy groove. Since the separation groove between liquid chambers has a width different from the dummy nozzle, a wider central dummy nozzle is in communication to the separation groove for the common liquid chamber. And when the sealing resin is poured from the separation groove between liquid chambers to the dummy nozzle, the sealant is first flowed into the central dummy nozzle, and when the sealant is filled in the central dummy nozzle, a meniscus is formed due to surface tension of sealing resin between the substrate and the dummy nozzle wall owing to a water repellent material covering the dummy nozzle wall and the surface of common liquid chamber separation groove opposite to the substrate, so that the sealant will flow from the dummy nozzle outwards into the gap between the orifice plate and the substrate. Hence, the separation between the liquid chambers and the nozzles can be achieved with good yield and securely.

<EXAMPLE 10>

Figure 17:
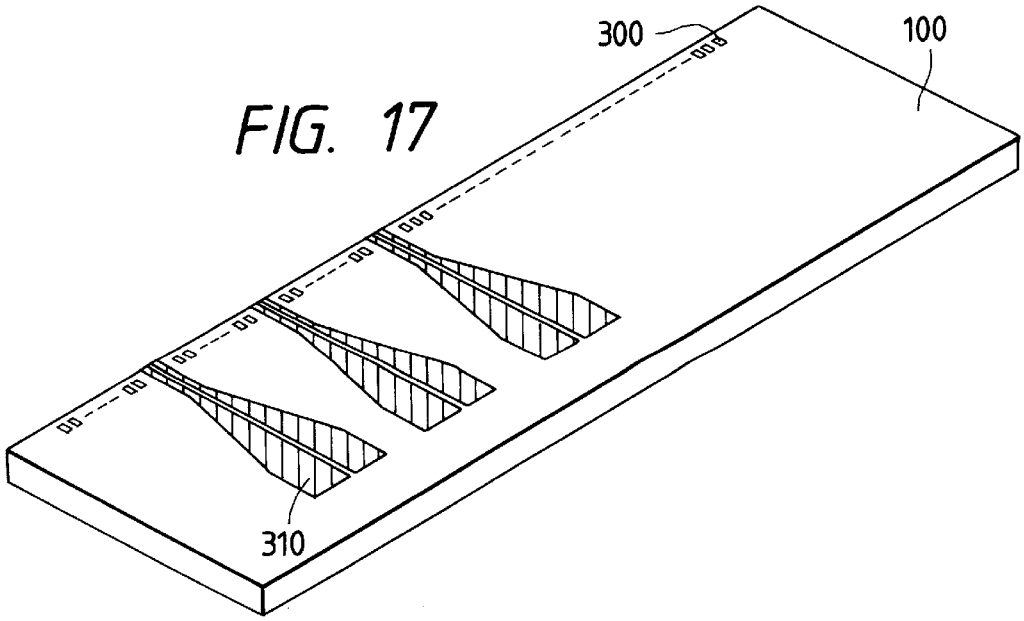
FIG. 17 is a view showing an example of an element substrate.

FIG. 17 shows a tenth example of the present invention. The contact faces of side wall portions of liquid chamber separation grooves of a grooved ceiling plate with a substrate 190 provided with discharge energy generators (e.g., electrothermal converters) 300 are covered with water repellent members 310.

The action is the same as in example 9. And when the sealing resin is poured from the separation groove between liquid chambers into the dummy nozzle, the sealant is first flowed into a central dummy nozzle, and when the central dummy nozzle is filled with the sealant, due to a water repellent member covering the dummy nozzle wall 115 and the surface of the common liquid chamber separation groove wall 150 opposite to the substrate, a meniscus is formed due to surface tension of the sealing resin between the substrate and the dummy nozzle wall, so that the sealant will flow from the dummy nozzle outwards into the gap between the orifice plate and the substrate. Hence, the separation between the liquid chambers and the nozzles can be made with good yield and securely.

<EXAMPLE 11>

In an eleventh example of the invention, water repellent members cover the contact faces of liquid chamber separation groove walls of a grooved ceiling plate with a substrate 100, as well as both the dummy nozzle walls 115 and the common liquid chamber separation groove walls 150.

The action is more effective than in examples 10 and 11. And when the sealing resin is poured from the separation groove between liquid chambers into the dummy nozzle, the sealant is first flowed into a central dummy nozzle, and when the central dummy nozzle is filled with the sealant, due to a water repellent member covering the contact face of both the dummy nozzle wall 115 and the common liquid chamber separation groove wall 150 with the substrate 190, a meniscus is formed due to surface tension of the sealing resin between the substrate and the wall, so that the sealant will flow from the dummy nozzle outwards into the gap between the orifice plate and the substrate. Hence, the separation between the liquid chambers and the nozzles can be made with good yield and securely.

The following example is intended to prevent the overflow of sealant from the separation grooves.

<EXAMPLE 12>

Figure 18:
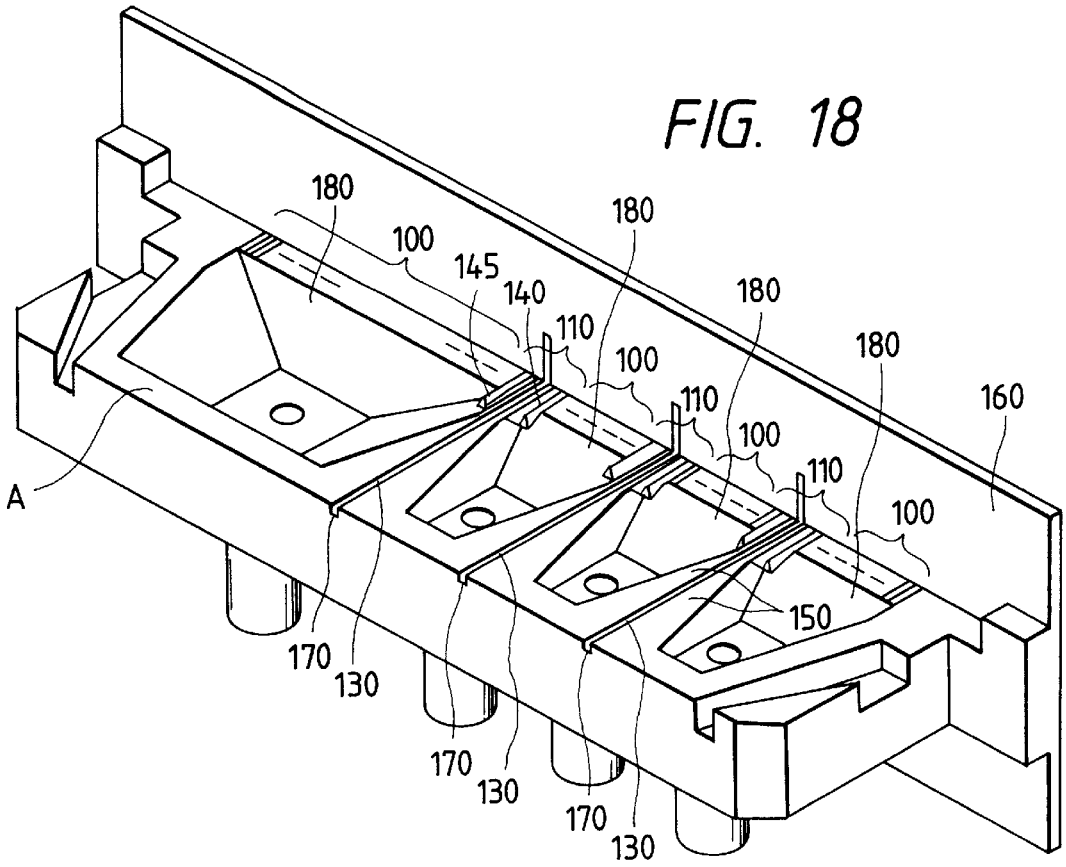
FIG. 18 is a typical view of a grooved ceiling plate.

A grooved member as shown in FIG. 18 has a junction face A which is joined with a silicon substrate (not shown) formed with electrothermal converters for giving the discharge energy to the ink, and an orifice plate 160 which is provided crosswise to the junction face A, the junction face A being formed with a plurality of recess portions 180 which are common liquid chambers for holding the ink, and a plurality of ink flow passages 100 corresponding to each recess portion 180, and the orifice plate 160 being formed with discharge ports for discharging the ink through ink flow passages 100. And a common liquid chamber separation groove wall 150 for separating between adjacent recess portions is disposed between each recess portion 180, and a common liquid chamber separation groove 130 is formed on the common liquid chamber separation groove wall 150 in the junction face A.

Figure 19:
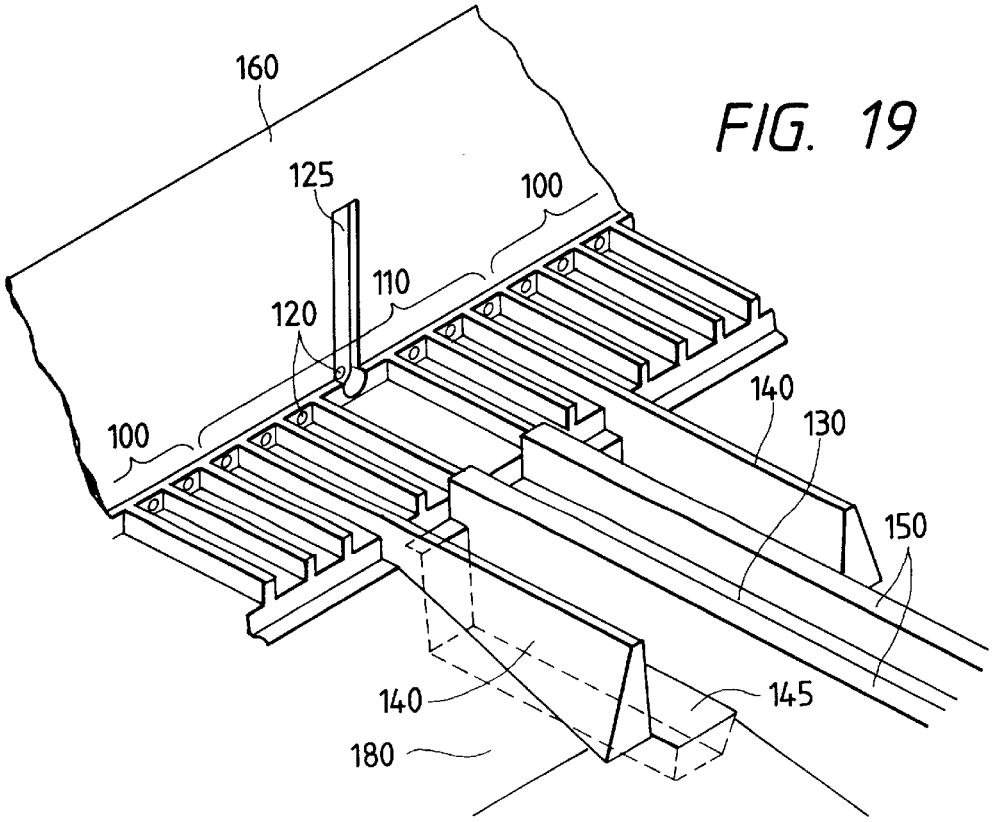
FIG. 19 is an enlarged view of a plurality of liquid chamber separation grooves in the nozzle portion of a grooved ceiling plate.

As shown in FIG. 19, seven dummy nozzles 110 are arranged between groups of ink flow passages 100 arranged adjacently. That is, dummy nozzles 110 are arranged at an interval equal to the groove pitch of the ink flow passages 100, and in particular, a centrally located dummy nozzle 110 has the width of two groove pitches of the ink flow passages 100, and is connected to a common liquid chamber separation groove 130, wherein three dummy nozzles 110 are formed symmetrical with respect to the central dummy nozzle 110 as the center to have the width of the groove pitch of the ink flow passages 100.

Also, the orifice plate 160 is bored with a hole 120 for each dummy nozzle 110, and is formed with a groove 125 leading to the hole 120 bored in the central dummy nozzle.

Further, a partition wall between a third dummy nozzle 110 and a fourth dummy nozzle 110 when counted from the central dummy nozzle connecting to a common liquid chamber separation groove 130 in the direction toward the ink flow passages 100 extends into a common liquid chamber 180 to serve as a liquid chamber separation groove wall 140. And between the liquid chamber separation groove wall 140 and the common liquid chamber separation groove wall is formed a bank for sealing resin 145 in a depth direction of the common liquid chamber 180.

Figure 20:
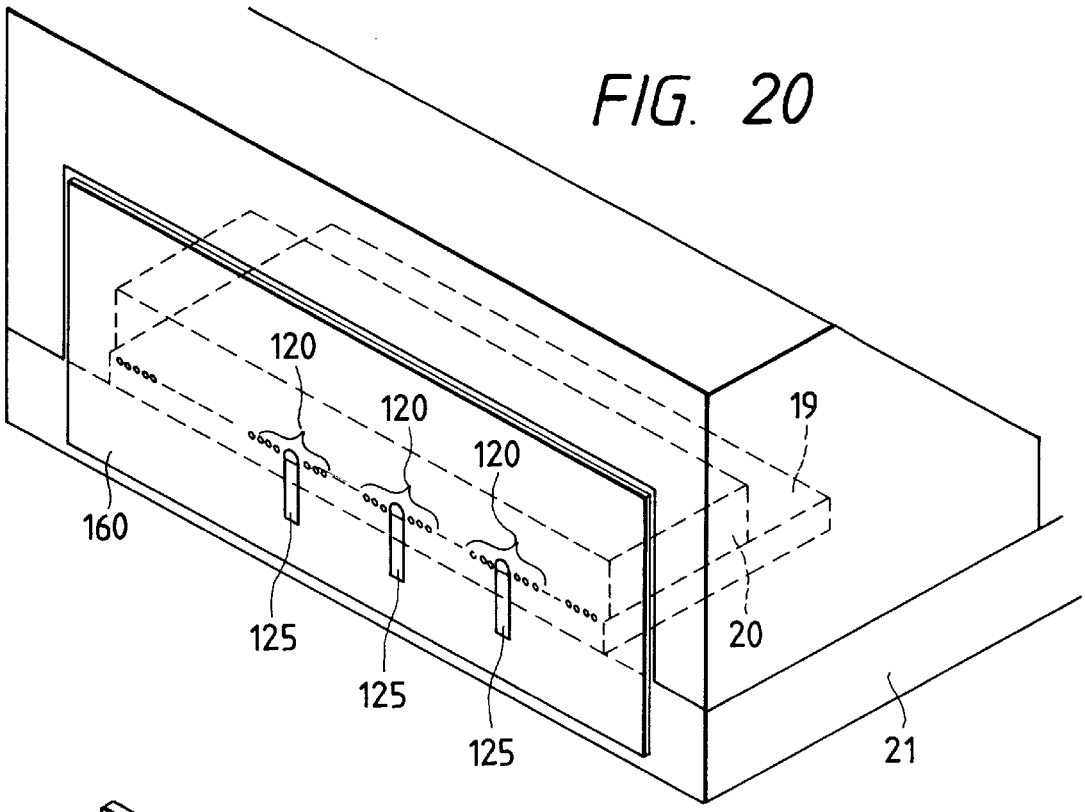
FIG. 20 is a perspective view showing one example of an ink jet head.

As shown in FIG. 20, the grooved ceiling plate 20 with the above constitution is joined, from the junction face A as shown in FIG. 18, with a silicon substrate 19 having electrothermal converters and a drive circuit incorporated therein, the silicon substrate 19 being bonded with an aluminum plate 21 by thermal conductive adhesive to complete an ink jet head of the invention. Note that the aluminum plate 21 serves to release the heat from the silicon substrate 19.

The action of this example will be described below with reference to FIGS. 18 to 20.

In the ink jet head as shown in FIG. 20, when the sealant is poured into the common liquid chamber separation groove 130 between common liquid chambers 180, the sealant is applied on the silicon substrate 19 around the sealant inlet opening 170 of the grooved ceiling plate 20 as the grooved member by means of a dispenser. The applied sealant flows in the common liquid chamber separation groove 130 due to capillary phenomenon to come to the dummy nozzles 110.

In this case, the sealant is first flowed into a central dummy nozzle 110. And after the central dummy nozzle 110 is filled with the sealant, the sealant overflows from near the common liquid chamber separation groove walls and then from the dummy nozzles 110 adjacent to the central dummy nozzle 110 to flow successively into adjacent dummy nozzles 110. Finally, the sealant is necessary to stop within seven dummy nozzles 110.

Thus, in pouring the sealant, by forming a pool for sealant in the dummy nozzle 110 adjacent to the central dummy nozzle 110, that is, providing a pool for sealing resin 145, as the sealant may overflow from the common liquid chamber 180 into the adjacent dummy nozzles 110, in such a way as to sink a portion of the common liquid chamber near the dummy nozzle 110 in a depth direction of the liquid chamber, the sealant overflowing from the dummy nozzles 110 is flowed into the bank for sealant 145 and kept from flowing into the ink flow passages 100.

Further, when the sealant is poured successively from the central dummy nozzle 110 to the adjacent dummy nozzles 110, the sealant must not be finally flowed around the ink flow passages. Therefore, in this example, the partition wall is formed between the third dummy nozzle 110 and the fourth dummy nozzle 110 when counted from the central dummy nozzle 110 in the direction toward the ink flow passages 110 to extend into the inside of the common liquid chamber 180. Thereby, the sealant is likely to stop at the third dummy nozzle 110, and is neither flowed into the fourth dummy nozzle 110 adjacent to the ink flow passages 100 nor passed around the ink flow passages 100.

Also, for pouring the sealant into the dummy nozzles 110, a hole 120 is bored in the orifice plate 160 for each dummy nozzle 110 for more easily bringing the sealant into the orifice plate 160, because the air will be exhausted due to the sealant flowed into the dummy nozzles 110. The sealant brought into each dummy nozzle 110 will not extend beyond the surface of the orifice plate 160 due to surface tension over the hole 120 of the orifice plate 160, so that the sealant is filled between the orifice plate and the silicon substrate in the dummy nozzle portion.

Accordingly, in this example, the ink jet head comprises a plurality of common liquid chambers, sealant inlet grooves for separation between common liquid chambers, and dummy nozzles similar to ink flow passages in the region between common liquid chambers and in line with ink flow passages to form the wall for preventing the sealant from flowing into the ink flow passages, and a grooved member which allows the sealant to come to the orifice plate reliably as the air inside can be exhausted by pouring the sealant due to a hole bored in the orifice plate corresponding to the dummy nozzle, wherein a plurality of dummy nozzles are formed, and a pool for sealant is formed by sinking a portion of common liquid chamber near the dummy nozzle in a depth direction of the liquid chamber, whereby the separation between common liquid chambers can be made reliably without sealant passing around the ink flow passages, and further the wall between the third nozzle and the fourth nozzle which is located one nozzle inside from the dummy nozzle adjacent to the ink flow passage is extended into the inside of common liquid chamber to provide a stop for overflowing sealant, so that the sealant is likely to stop at the third dummy nozzle to effect the separation between common liquid chambers more reliably without the ink passing around the ink flow passages, and the improved yield is attained.

<EXAMPLE 13>

Figure 21:
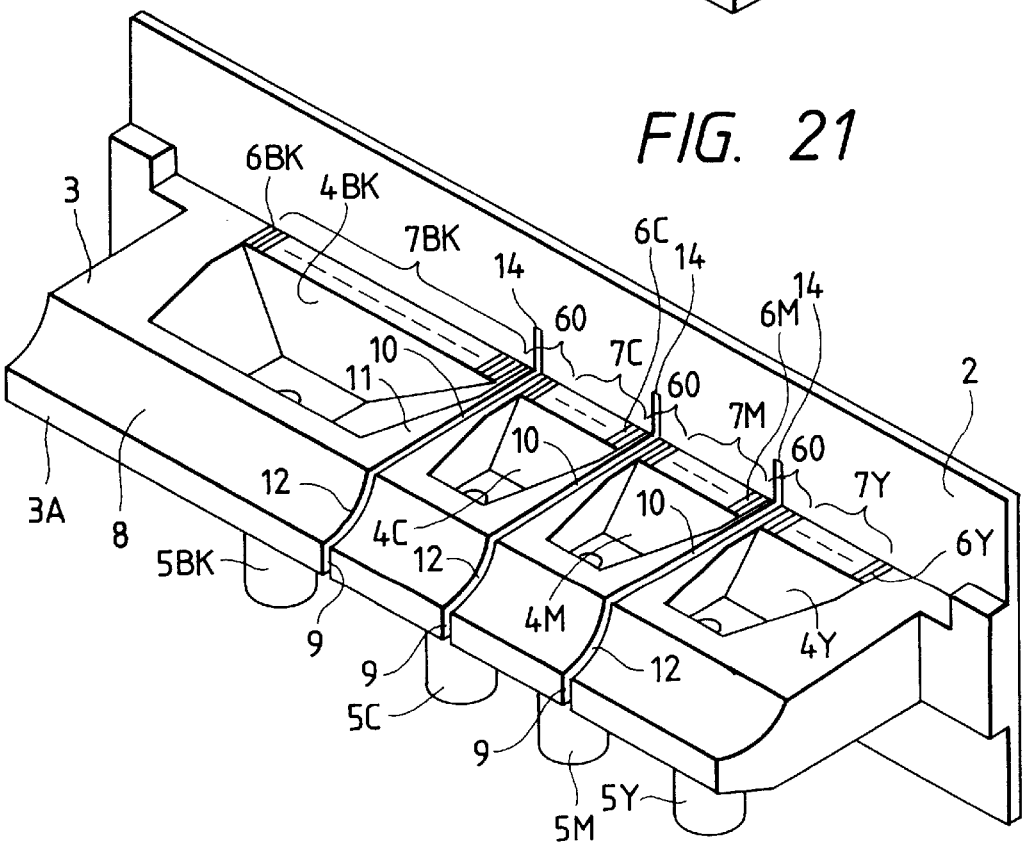
FIG. 21 is a typical view of a grooved ceiling plate.
Figure 22:
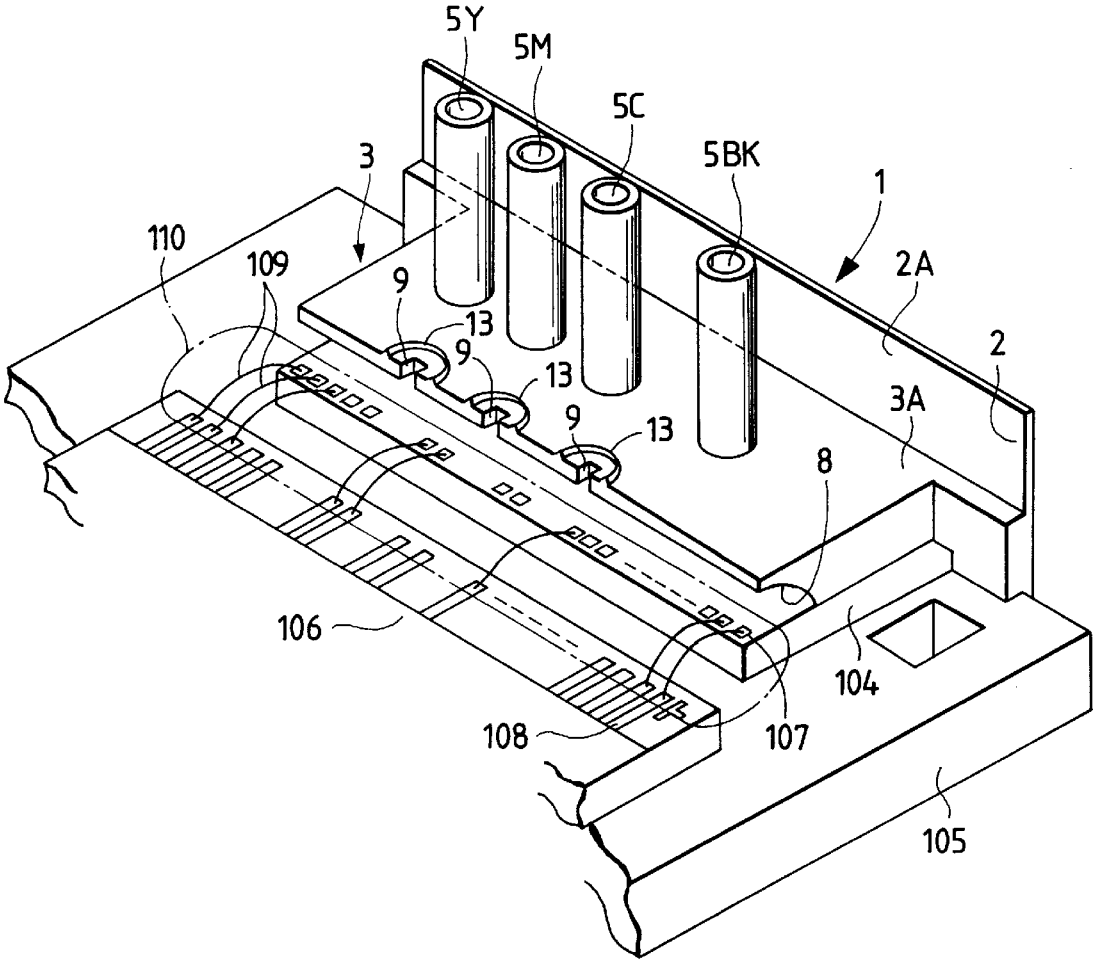
FIG. 22 is a perspective view showing the constitution of an ink jet head.
Figure 23:
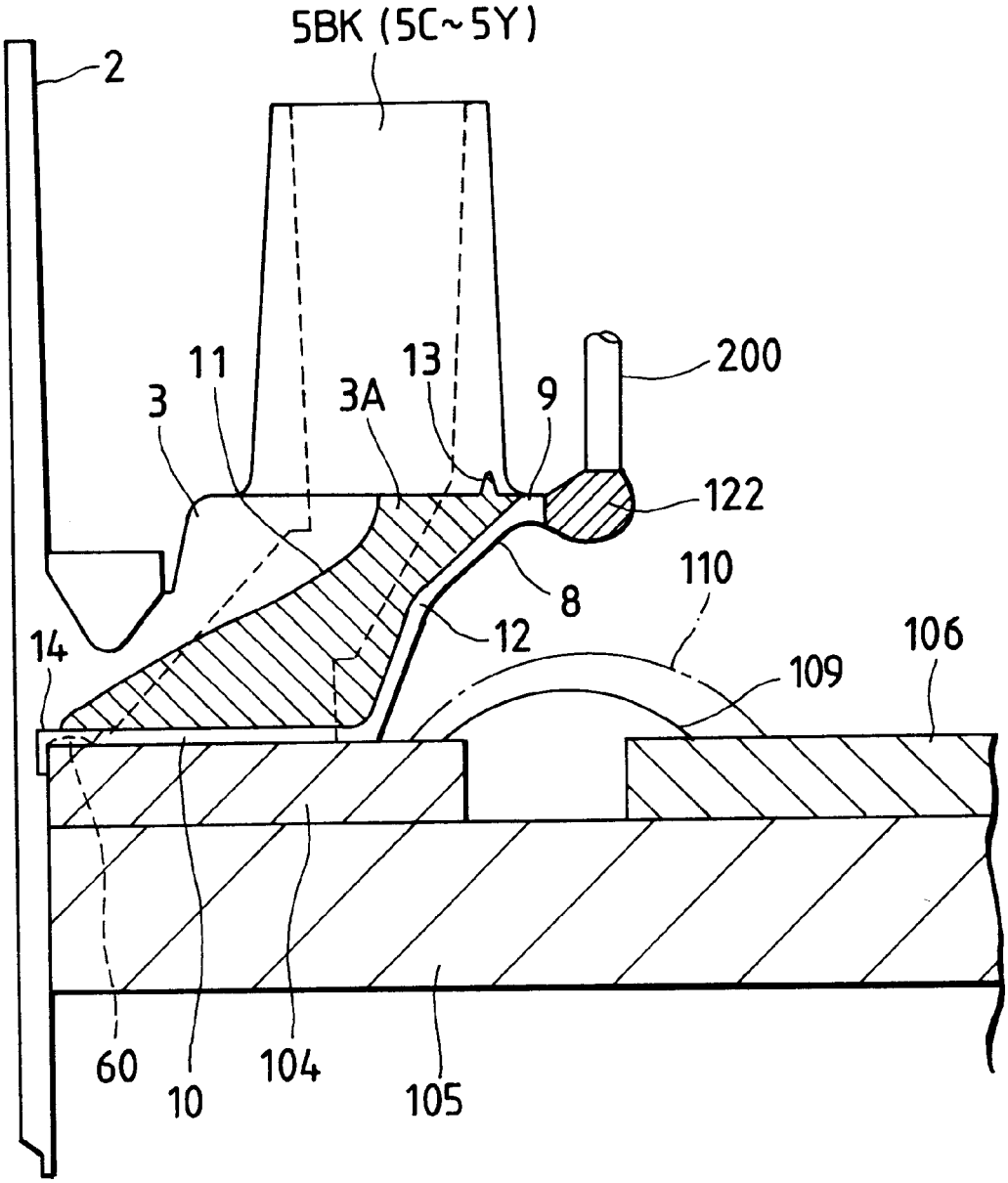
FIG. 23 is a cross-sectional view of the ink jet head.

FIGS. 21 to 23 show the constitution of an ink jet head according to the thirteenth example of the invention. FIG. 21 shows a ceiling plate (grooved member) 3 which is formed integrally with an orifice plate 2 of the ink jet head 1 as viewed from the back side, the ink jet head 1 for the color being separately formed with four common liquid chambers of 4BK, 4C, 4M and 4Y in this example. 5BK, 5C, 5M and 5Y are formed corresponding to common liquid chambers 4BK, 4C, 4M and 4Y. 5BK, 5C, 5M and 5Y are ink supply passages extending from the top plane of common liquid chambers 4BK, 4C, 4M and 4Y, and 6BK, 6C, 6M and 6Y are liquid channels into which the inks of black (BK), cyan (C), magenta (M) and yellow (Y) are introduced from respective common liquid chambers 4BK, 4C, 4M and 4Y. 7BK, 7C, 7M and 7Y are ink discharge ports for discharging the inks of colors introduced into the liquid channels 6BK, 6C, 6M and 6Y. Note that in addition to the above liquid channels and the ink discharge ports, dummy liquid channels 60 having no discharge function and corresponding dummy ink discharge ports are provided.

Also, 8 is a concave surface (hereinafter referred to as a relief face) according to the invention which is formed by cutting the top portion 3A of the grooved member 3 near the rear end thereof smoothly and concavely toward the junction face with a heater board 104, 9 is a sealing resin inlet opening provided at the rear end of the top portion 3A of the grooved member 3, 10 is a separation groove formed on a partition wall 11 between common liquid chambers, and 12 is a resin guide groove formed along the relief face 8 for guiding the sealing resin from each inlet opening 9 into each separation groove 10. Furthermore, in this example, a rib (hereinafter referred to as a flow stop rib) 13 of semicircular shape for preventing the diffusion of resin is provided around each resin inlet opening 9 at the top portion of the grooved member, as shown in FIGS. 22 and 23. On the back face 2A of the orifice plate 2 is formed a sealing groove 14, communicating to each separation groove 10, which serves to guide the resin therealong from each separation groove 10 for the sealing between the orifice plate rear face 2A and the heater board 104 by pouring the sealing resin as described below and shown in FIG. 21 and FIG. 23.

In assembling the ink jet head thus constituted, the heater board 104 and a wiring substrate 106 are fixed by adhesive at their predetermined positions on a base board 105 made of metallic material such as aluminum which is easy to release the heat, respectively, with bonding wires 109 disposed to electrically connect corresponding terminals between the heater board 104 and the wiring substrate 106. And a wire bond sealing portion 110 made of an insulator for the protection is covered on the portion including the bonding wires 109 and pads 107, 108 at both ends. Subsequently, the groove member 3 having the orifice plate 2 formed as shown in FIG. 21 is joined by adhesive on the heater board 104, in which case it is necessary to keep the partition walls 11 between common liquid chambers 4BK, 4C, 4M and 4Y sufficiently sealed.

In this example, in making the sealing, the sealing resin 122 is injected through the tip of a syringe needle 200, with the syringe needle 200 held near the inlet opening 9 provided at the rear edge of the top portion 3A of the grooved member, as shown in FIG. 23. In this way, the sealing resin 122 injected in excess quantity is restricted by the flow stop rib 13 provided on the top portion 3A of the grooved member from flowing over the top portion 3A, falling down along the resin guide groove 12 provided on the relief face 8 of the grooved member 3 due to capillary action force as well as gravitational force, and further permeating into the rear face 2A of the orifice plate 2. And the sealant finally comes to the rear face 2A of the orifice plate 2, and is guided along the sealing groove 14 and the dummy liquid channels 60, in which state all the resin 122 is cured. Note that the dummy discharge ports communicating with the dummy liquid channels 60 act as the air vent, and function to hold the resin 122 having come to the dummy discharge ports therearound due to the action of surface tension.

In this example, since the inlet openings 9 are provided at the rear edge of the top portion 3A of the grooved member, with the relief face 8 of the grooved member 3 concaved forward, the syringe needle will not interfere with the wire bonding sealing portion 110 to impair the sealing portion 110, even though the syringe needle 200 has more or less variations in the injection position. Also, the heater board 104 is unnecessary to extend rearwards of the rear end of the grooved member 3, so that the length of the heater board 104 in the direction orthogonal to the discharge face can be limited to the minimum value as required.

<EXAMPLE 14>

Figure 24:
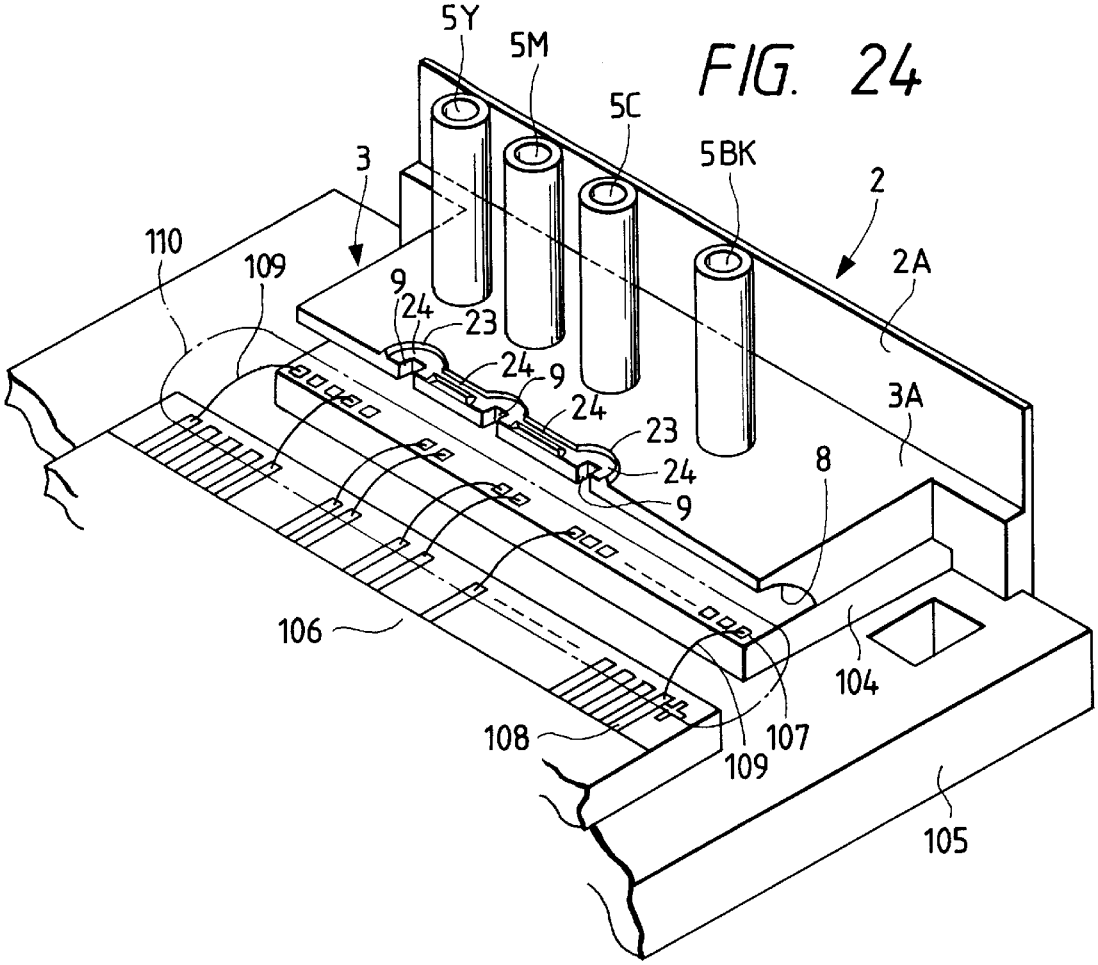
FIG. 24 is a perspective view showing the constitution of an ink jet head.
Figure 25:
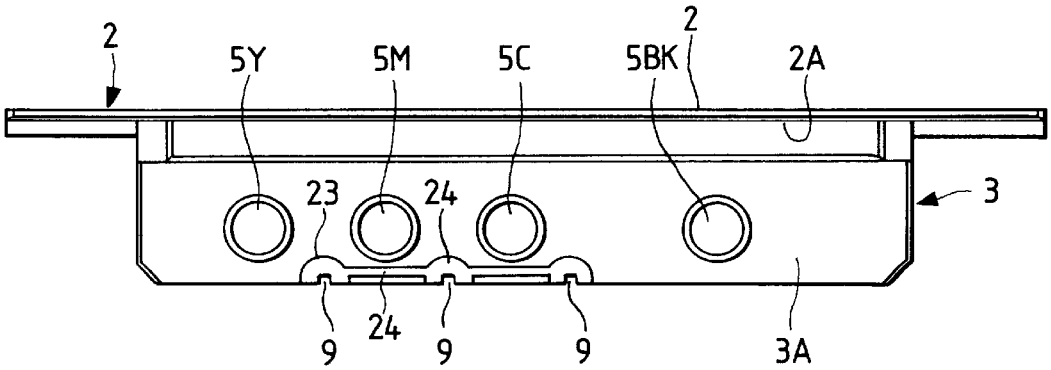
FIG. 25 is an upper view of a grooved ceiling plate.

FIGS. 24 and 25 show a fourteenth example of the invention. While in the thirteenth example, the sealing resin 122 is poured into individual inlet openings 9, it is noted that in the fourteenth example, the sealant 122 can be poured into a plurality of inlet openings 9 substantially at the same time. Therefore, in this fourteenth example, inlet passages 24 with ribs 23 are provided on the top portion 3A of the grooved member to be able to communicate to the plurality of inlet openings 9, as shown in these figures. Note that in forming such inlet passages 24, it may be also possible to form a groove for communicating commonly to the plurality of inlet openings, instead of surrounding the inlet passages 24 with the ribs 23. This is true with the thirteenth example. And instead of the ribs 13, the peripheral portion of the inlet openings 9 may be formed at a lower level by one step.

In this way, by forming the inlet passages 24 for the plurality of inlet openings 9 on the top portion 3A of the grooved member, the sealing resin can be led to the plurality of inlet openings 9 only by supplying the sealing resin to a free site in the inlet passages 24 by means of a syringe needle, and can seal the region between the common liquid chamber and the liquid channels for each color from the inlet opening 9 through the same path as in the thirteenth example. Accordingly, it is unnecessary to move the syringe needle near the inlet openings, wherein the injection process can be shortened in time and the operation simplified.

<EXAMPLE 15>

Figure 26:
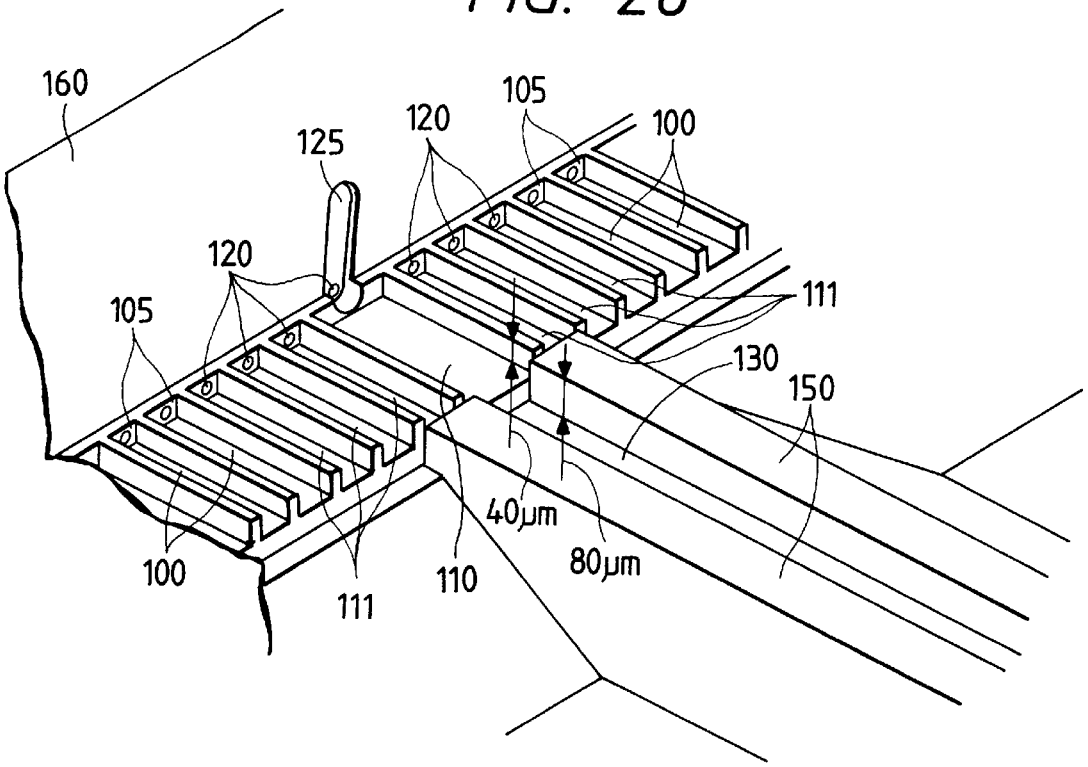
FIG. 26 is an enlarged perspective view around ink flow passages of an ink jet head.

As shown in FIG. 26, a grooved member of this example is formed in such a manner that when ink flow passages 100 communicating to the same recess portion 180 are one group of ink flow passages, a plurality of dummy nozzles 110, 111 formed similarly to ink flow passages are formed between mutually adjacent groups of ink flow passages, and in particular, at least a central dummy nozzle 110 is wider than ink flow passages 100, and substantially as wide as a common liquid chamber separation groove 130 as will be described later. The dummy nozzles 110, 111 are in communication with the outside through holes 120 formed in the orifice plate 160, and in particular, at least a central hole 120 is led to a groove 125 formed on the back face of the orifice plate 160.

On the other hand, on a junction face of each common liquid chamber separation wall with a silicon substrate 190 is formed a common liquid chamber separation groove 130 extending from the side end (top end) of the orifice plate 160 to the other end (rear end) thereof, its top end being in communication with the central dummy nozzle 110. Also, the rear end of each common liquid chamber separation groove 130 serves as a sealant inlet opening 170 for pouring the sealant for the sealing between common liquid chambers after joining a ceiling plate 200 with the silicon substrate 190, the width of the sealant inlet opening being greater than the width of common liquid chamber separation groove 130. That is, the size of the sealant inlet opening 170 is greater than the cross section of the common liquid chamber separation groove 130.

In this example, using polysulfone as the molding resin, the ceiling plate 200 was formed by injection molding under the conditions where the plasticizing temperature was about 400° C. and the mold temperature was about 150° C. Note that the forming method of the ceiling plate having the ink flow passages and the common liquid chambers is not limited to an injection molding method, but may be a liquid casting method using a similar mold or a transfer mold method. However, the subject of the present invention resides in providing an inexpensive color recording head with good mass productivity, and from such a respect, the injection molding method having a short molding cycle is desirable.

Figure 27:
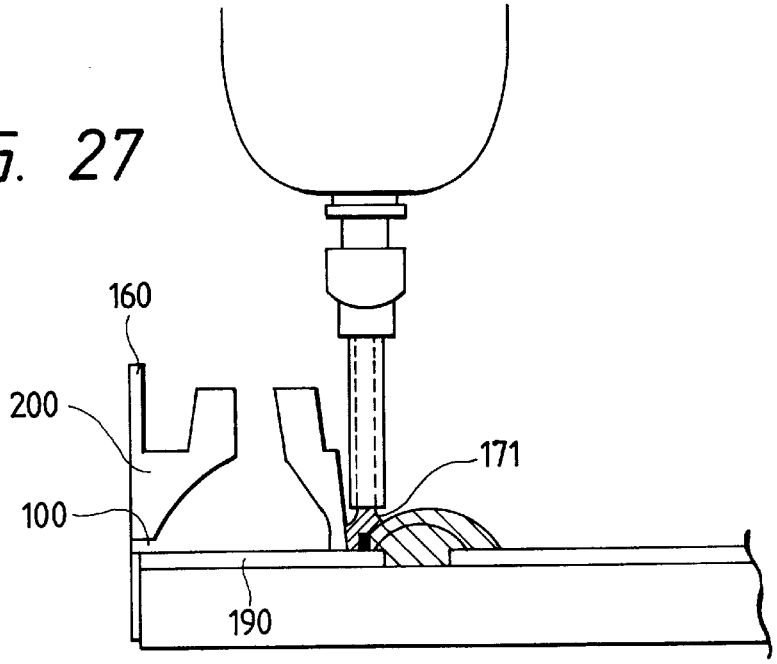
FIG. 27 is a view for explaining a sealing process.

Referring now to FIG. 27, the process of pouring the sealant on the basis of the above constitution will be described below.

Figure 28:
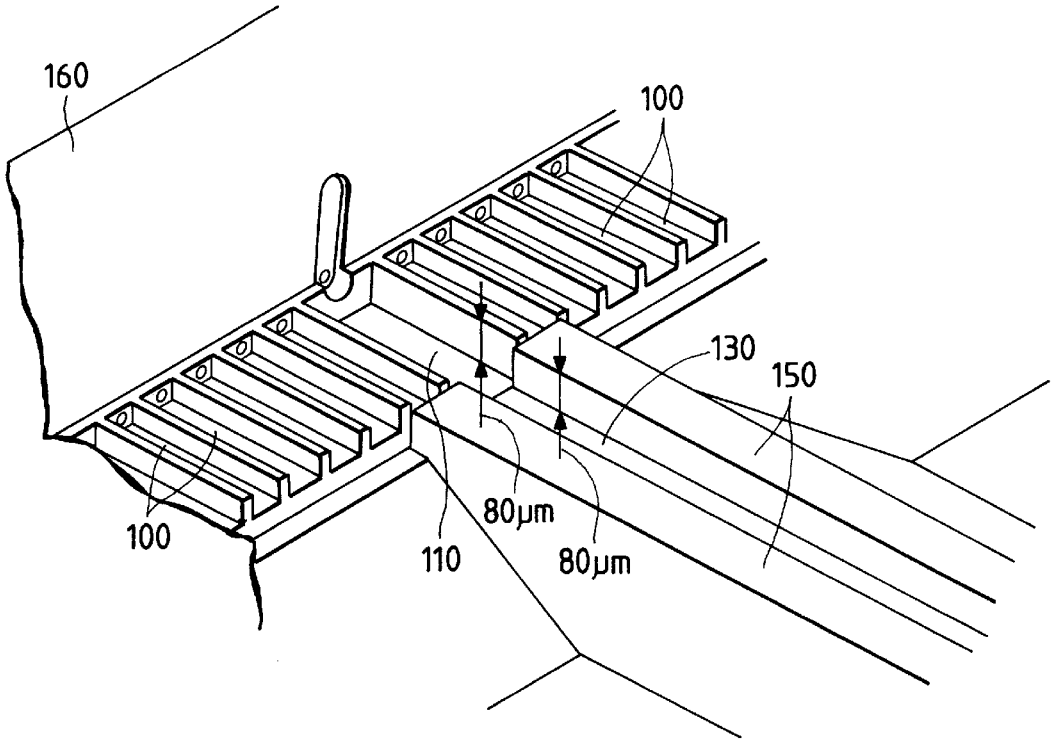
FIG. 28 is an enlarged view of the essence of a grooved member.

FIG. 27 is a cross-sectional view of the essence of a common liquid chamber separation sealing process in the ink jet head as shown in FIG. 28.

As shown in FIG. 27, in pouring the sealant, the sealant 171 is first applied on the silicon substrate 190 rearwards of the sealant inlet opening 170 by using pouring means such as a dispenser. The sealant 171 applied on the silicon substrate 190 will enter the common liquid chamber separation groove 130 due to capiliary phenomenon, and further come to the central dummy nozzle 110. After the central dummy nozzle 110 is filled with the sealant 171, the sealant 171 will overflow from the central dummy nozzle 110, and enter the dummy nozzles 111 outwardly adjacent thereto from the back side. This operation is repeated successively until the dummy nozzles 110, 111 are filled with the sealant. Also, since each dummy nozzle 110, 111 is in communication with the outside through a respective hole 120, the sealant can be brought into the through hole 120 which serves to allow the air to escape inside the dummy nozzle 110, 111 when the sealant 171 is entered. Then, the sealant 171 is held within the hole 120 due to surface tension, thereby sealing completely the region between common liquid chambers.

Further, the groove 125 leading to the central dummy nozzle 110 is formed on the orifice plate 160, thereby serving to flow the sealant 171 to the contact face between the silicon substrate 190 and the orifice plate 160 to seal that contact face, while having the effect of allowing the excess amount of sealant 171 which may have entered to escape.

Herein, a die 71 for forming ink flow passages 100 within a mold for the ceiling plate 200 consisting of a black ink flow passage having a discharge amount of 80 ng and a color ink flow passage having a discharge amount of 40 ng had an even height of 40 $\mu$m for the ink flow passages 100 and the dummy nozzles 110, 111 for each color in the prior application. On the other hand, a die 73 for forming the common liquid chamber is worked with common liquid chamber separation grooves in a substantially square shape 80 $\mu$m wide and 80 $\mu$m high in cross section, in communication to the common liquid chambers and the dummy nozzles 110, 111 (see FIG. 26).

Therefore, the sealant 171 passing through the common liquid chamber separation groove is rapidly reduced in cross section as the width is substantially the same but the height is halved at the connecting portion with the central dummy nozzle 110, and this structure causes the sealant 171 to overflow into not only the dummy nozzles 111 but also the ink flow passages 100 (main nozzles), wherein it follows that the product is non-defective if the overflow is received within a plurality of dummy nozzles 111, or defective if it comes to the main nozzles.

Though as above described, the sealant 171 will overflow at the connecting portion between the common liquid chamber separation groove 130 and the central dummy nozzle 110, this is because the mold structure is necessary to divide on the functional design of the recording head, and the die 71 and the die 73 can not be incorporated with tolerance 0 as previously described, whereby giving priority to their adherence with the silicon substrate 190, the die 73 is incorporated with an offset of about 1 to 10 $\mu$m with respect to the die 71 forming the ink flow passage walls 100, resulting in a clearance through which the sealant 171 will overflow.

Accordingly, even if the material management such as viscosity of sealant 171 or tack free time, or the management for the precise control of the injection position of the dispenser or its injection amount is made, the sealant may not be smoothly entered into the connecting portion between the common liquid chamber separation groove and the dummy nozzles communicating thereto so that the sealant overflows into the ink flow passages (main nozzles).

<EXAMPLE 16>

FIG. 28 is an enlarged view of the essence of a sixteenth example of an ink jet head of the present invention.

As shown in FIG. 28, the height of ink flow passages 100 is 40 μm in this example, but using a die 71 for forming the ink flow passages 100 which has been worked to have the central dummy nozzle 110 with a height of 80 μm, a ceiling plate 200 is molded.

Based on such a constitution, when pouring the sealant 171, the sealant is entered through the sealant inlet opening 170 at the rear end of the ceiling plate 200 into the common liquid chamber separation groove 130 due to capillary phenomenon, and the sealant which has come to the central dummy nozzle 110 will advance smoothly forwards of the central dummy nozzle 110 without overflowing at the connecting portion between the common liquid chamber separation groove 130 and the dummy nozzle 110 since the central dummy nozzle 110 and the common liquid chamber separation grooves are substantially of the same width and height.

Accordingly, with the constitution of the invention, the improvements were made on the structure in which the height of dummy nozzles 110 is smaller than the height of the common liquid chamber separation grooves 130, which may constitute a factor of advance block, to obtain a smoothly admissible structure, it being confirmed that the separation between common liquid chambers can be made with good yield.

In this example, as the sealant 171 for sealing the common liquid chamber separation grooves 130, a room temperature curable liquid silicone resin (TSE-399) made by Toshiba Silicone was used, wherein the sealant having a viscosity of about 3000 cP and a tack free characteristic of about five minutes was optimal in this example. Also, the amount of sealant 171 required in practice to seal the region between common liquid chambers is 0.1 mg or less per common liquid chamber separation groove 130, but with the constitution of the invention, there was no risk that the ink flow passages 100 would cause the clogging with an application amount of sealant 171 of 3 mg to 10 mg which permitted the stable discharge in the mass production process.

The material for sealing the common liquid chamber separation grooves 130 may be optimally a liquid silicone resin from the review made in the past, as above described, but in order to reliably advance such material over the distance from the rear end of the common liquid chamber of the ink jet recording head to the orifice plate 160, it has been found that it is desirable to provide the grooves, 80 μm wide and 80 μm high, in cross section. This is based on the experimental results that with the reduced cross section, the capillary force will increase, but as the sealant is entering, the flow resistance will increase, so that the sealant 171 may stop halfway of the common liquid chamber separation groove 130, causing an incomplete sealing, while with the larger cross section, the capillary force is weaker, so that the sealant may also stop halfway thereof.

Additionally, as a result of examination of how large the cross section at the rear end of the central dummy nozzle 110 is needed to effect the stable sealing without causing any problem on the mass production, the reduction in the area up to 20% was permitted, because it was difficult to attain the close contact between the common liquid chamber separation walls 150 and the silicon substrate 190 from the respect of die incorporation. Also, as a result of examining the width and height independently, the reduction in the width and height was at most 20% if the reduction in the cross section was within 20%. That is, it was confirmed that when the height of the common liquid chamber separation grooves 130 is 80 μm, the same effects can be exhibited as long as the height of the dummy nozzle 110 is reduced 20% or about 64 μm or greater.

Figure 29:
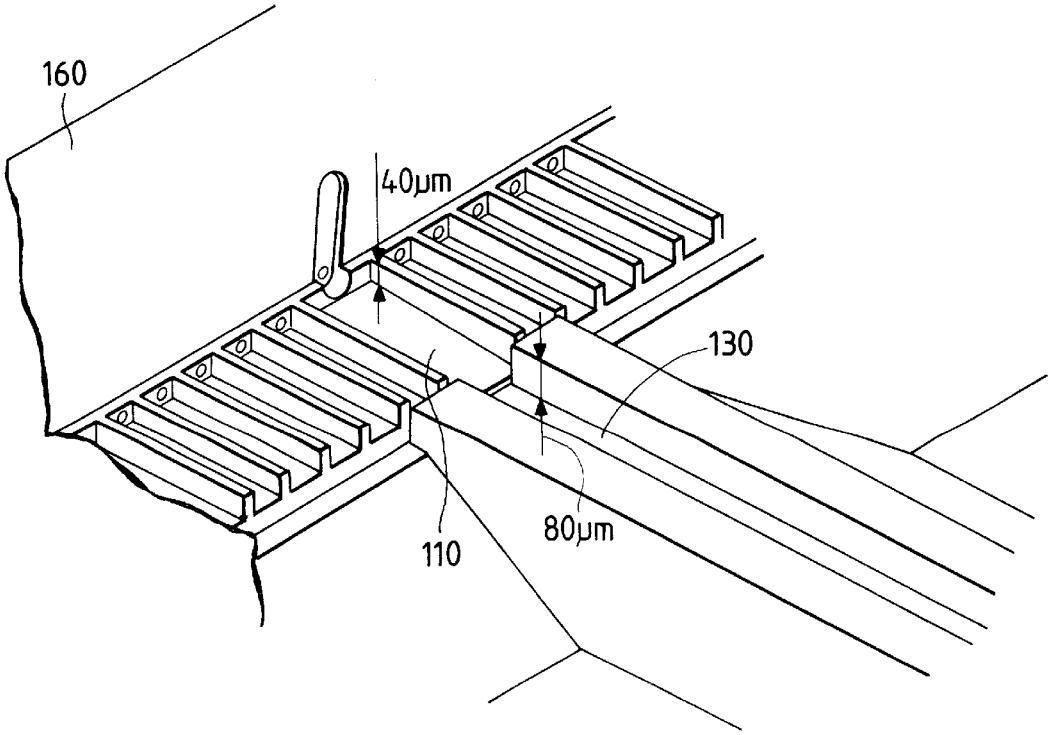
FIG. 29 is an enlarged view of the essence of a grooved member.

If the central dummy nozzle 110 may not be 64 μm or greater high, but the connecting portion with the common liquid chamber separation grooves 130 and its neighborhood is 64 μm or greater to achieve the smooth admission of sealant 171, it does not matter that the height of the central dummy nozzle on the side of the orifice plate 160 may be gently inclined toward the height of 40 μm, for example, as shown in FIG. 29.

<EXAMPLE 17>

Figure 30:
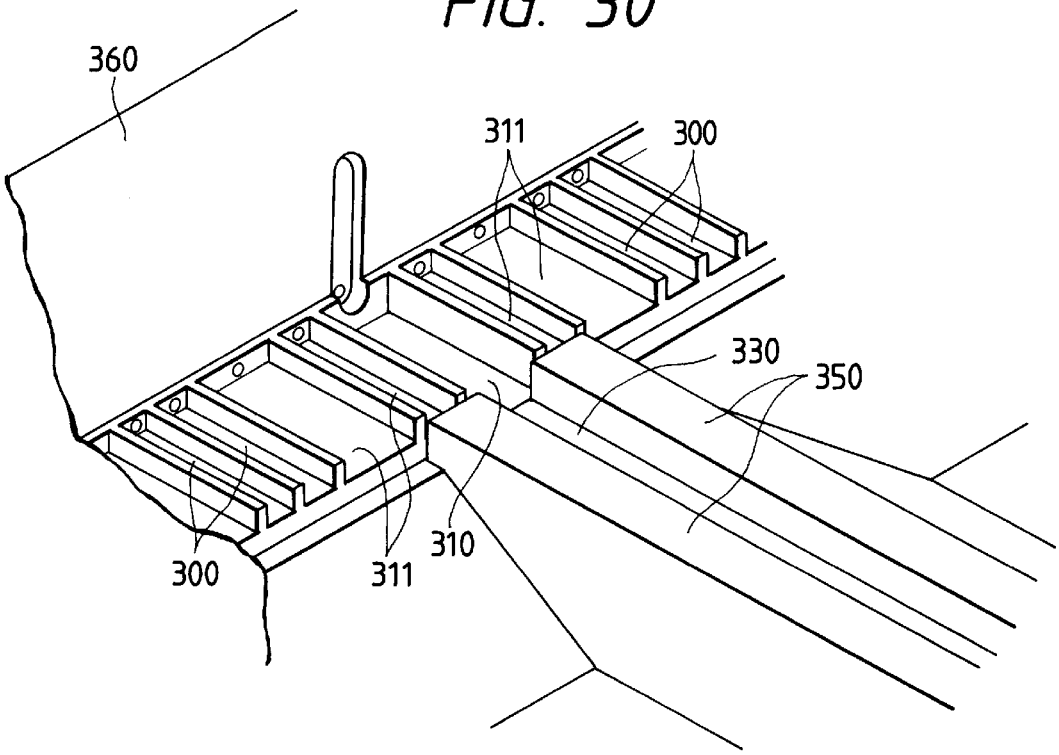
FIG. 30 is an enlarged view of the essence of a grooved member.

FIG. 30 is an enlarged view of the essence of a seventeenth example of an ink jet head of the invention.

As shown in FIG. 30, this example is different from the sixteenth example in that the area of the transverse cross section of a second dummy nozzle 311 from the center and contact with a common liquid chamber separation wall 350 is smaller than the area of the transverse cross section of a third dummy nozzle 311 from the center and adjacent to the ink flow passage 300. Other constitution is the same as in the sixteenth example, and is not described.

With such constitution, a die for forming the ink flow passages and a die for forming the common liquid chamber which have been incorporated at high precision by injection pressure may undesirably have a step as large as 20 μm or greater, while continuing the molding of the ceiling plate in mass production, so that the sealant may overflow into the ink flow passages 30 (main nozzles) through the step as large as 20 μm or greater between the common liquid chamber separation wall 350 and the silicon substrate, but owing to a difference in the capillary force given between the second dummy nozzle and the third dummy nozzle from the center, the sealant having come to the dummy nozzles except for the central dummy nozzle 310 is drawn into the second dummy nozzle 311, and is difficult to flow toward the ink flow passages (main nozzles) 300, causing no problem of the clogging in the ink flow passages.

While the amount of sealant necessary to seal the region between common liquid chambers in practice is 0.1 mg or less per common liquid chamber separation groove 330, the application amount of sealant is 5 mg to 50 mg where the stable discharge is allowed in the mass production process, so that no clogging of ink flow passages occurred, with the constitution of this example.

Accordingly, in this example, even if the step between the die for forming the ink flow passages and the die for forming the common liquid chamber is 20 μm or greater, the ceiling plate can be manufactured without any maintenance of the mold for the ceiling plate, resulting in the stable sealing, as previously described.

It is the same with the sixteenth example that if the cross section of the central dummy nozzle 310 at the rear end is reduced up to 20% as compared with that of the common liquid chamber separation groove 330, the same effects can be exhibited. Also, if the whole of the central dummy nozzle 310 is not 64 μm or greater but the connecting portion with the separation groove and its neighborhood is 64 μm or greater to achieve the smooth admission of sealant, it does not matter that the height of the dummy nozzle on the side of the orifice plate may be gently inclined toward the height of 40 μm, as shown in FIG. 29.

<EXAMPLE 18>

Figure 31:
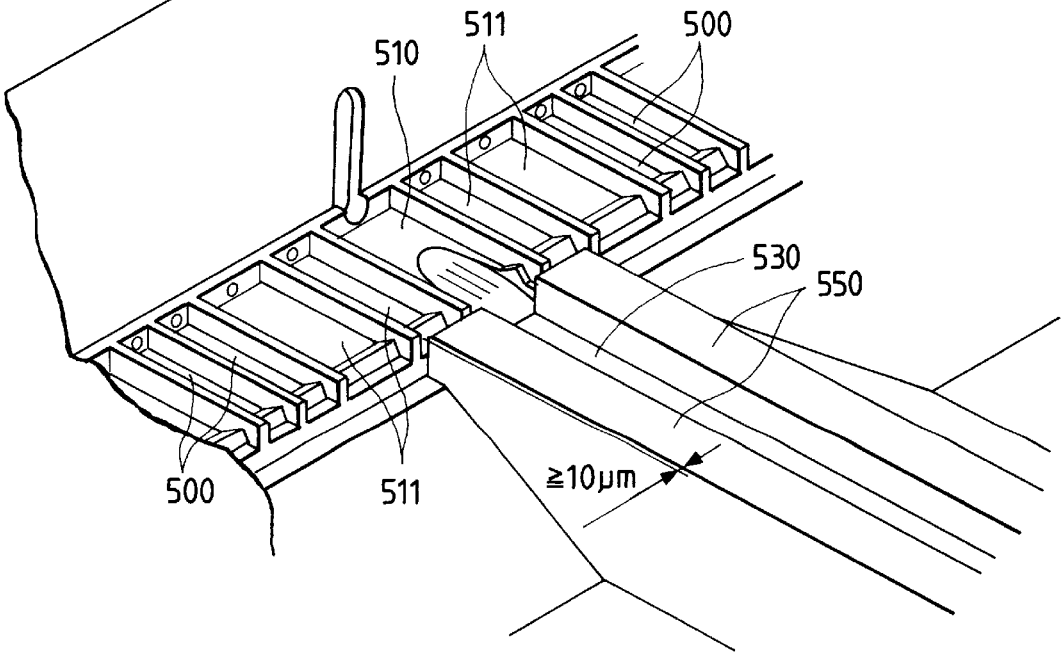
FIG. 31 is an enlarged view of the essence of a grooved member.

FIG. 31 is an enlarged view of the essence of an eighteenth example of an ink jet head of the invention.

This example is different from the seventeenth example in that a gap of 10 μm or greater is provided between a second dummy nozzle 511 from the central dummy nozzle 510 and the top end face of the common liquid chamber separation wall 550. The remaining constitution is the same as in the seventeenth example, and is not described.

With such a constitution, owing to the provision of a clearance of 10 μm or greater between the second dummy nozzle 511 from the center and contact with the common liquid chamber separation wall 550 and the common liquid chamber separation wall 550, despite variations in the gap between the common liquid chamber separation wall 550 of the ceiling plate and the substrate due to difference of molding cavity in the mass production of the ceiling plate, there occurs a difference in the capillary force between the second dummy nozzle and the third dummy nozzle, as described in the seventeenth example, so that the sealant having come to the rear end of the dummy nozzles 511 except for the central dummy nozzle 510 is drawn into the second dummy nozzle 511, and is difficult to flow in the direction of the ink flow passages (main nozzles) 500, whereby even if excess sealant applied enters the common liquid chamber separation grooves 530 to come to the connecting portion with the central dummy nozzle 510, the problems associated with the clogging of ink flow passages 500 or the incomplete sealing can be resolved.

Further, when the common liquid chamber separation walls 550 near the sealant inlet opening of the ceiling plate are joined with a clearance as large as 30 μm which is essentially undesired while the ink flow passage walls are placed into close contact with the substrate, it has been confirmed that the invention can exhibit the effects of extending the manufacturing margin of other process, because the second dummy nozzle 511 is retracted due to capillary force, as previously described, even if the sealant is entered from the neighborhood of the sealant inlet opening along the common liquid chamber separation groove 530 as well as from under or within the common liquid chamber walls.

<EXAMPLE 19>

While each of the above-described examples is an example of a four liquid chamber head for the color recording consisting of 24 nozzles for each color of yellow, magenta and cyan having a discharge volume of 40 ng, and 64 nozzles for black having a discharge volume of 80 ng, this example is a monochrome four liquid chamber head for the recording of five values including dark black ink, medium dark black ink, medium light black ink, and light black ink.

Figure 32:
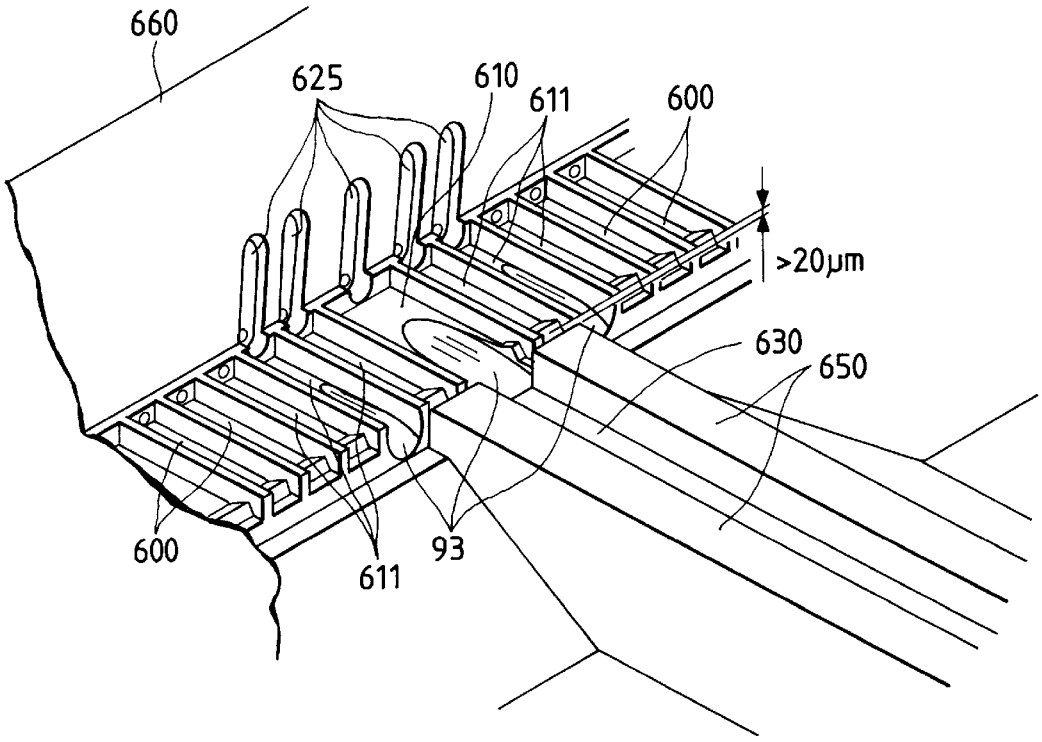
FIG. 32 is an enlarged view of the essence of a grooved member.

FIG. 32 is an enlarged view of the essence of a nineteenth example of an ink jet head of the invention.

As shown in FIG. 32, this example is different from the sixteenth example in that sinks 693 are provided on the central dummy nozzle 610 communicating to common liquid chamber separation grooves 630 as well as on the third dummy nozzle 611 from the center through a fluid resistance element removal process, and further grooves 625 are provided for not only the central dummy groove 610 but also second and third dummy nozzles 611 from the center. Other constitution is the same as in the sixteenth example, and is not described.

With this constitution, the incorporating relation between a die for forming the common liquid chamber and a die for forming the ink flow passages and the dummy nozzles was described, but the common liquid chamber separation walls 650 are not completely in contact with the substrate, but are floating. Therefore, the sealant entering through the sealant inlet opening advances through the common liquid chamber separation groove 630, while in practice some meniscus is formed under and inside the common liquid chamber separation walls 650. If the die for forming the ink flow passages and the die for forming the common liquid chamber are in the normal incorporating relation, there is no problem, but with the ceiling plate having a difference of 20 μm or greater wherein the incorporating relation is deviated (typically the offset being wider) due to the action of injection pressure while the injection molding is repeated, as a result that the third dummy nozzle from the center is sunk by excimer laser to have an increased cross section, the second dummy nozzle has a smaller cross section than the third dummy nozzle so that the sealant is likely to form a meniscus, and has a stronger capillary force than the third dummy nozzle, whereby the sealant flowing from the common liquid chamber separation groove 630 under the common liquid chamber separation walls 650 can be used for the stable manufacture without any maintenance of the mold for molding the ceiling plate. Further, owing to the provision of the grooves 625 formed not only in the central dummy nozzle 610 on the side of the orifice plate 660 but also in the third dummy nozzle 611 from the center, excess sealant can be flowed away through the grooves, even if the sealant comes to the third dummy nozzle.

<EXAMPLE 20>

Figure 33:
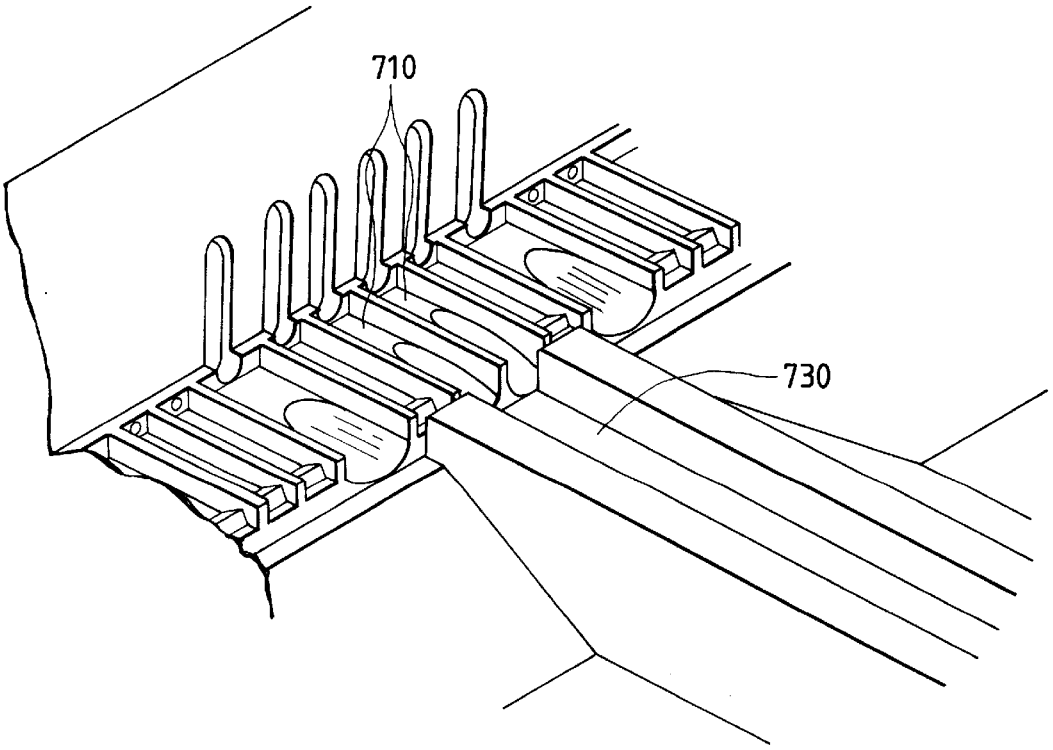
FIG. 33 is an enlarged view of the essence of a grooved member.

FIG. 33 is an enlarged view of the essence of a twentieth example of an ink jet head of the invention.

As shown in FIG. 33, in this example, the central dummy nozzle 710 communicating to common liquid chamber separation grooves 730 is two nozzles but not one nozzle. Other constitution is the same as in the sixteenth example, and is not described.

With such a constitution, if the total cross section at the rear end of two central dummy nozzles 710 is reduced by below 20% as compared with the cross section at the top end of common liquid chamber separation grooves 730, the effects can be exhibited due to the same action as described in the sixteenth example.

While in each of the above examples, an ink jet head having four common liquid chambers was described for convenience sake, it is needless to say that it is the same with a recording head having more common liquid chambers or a recording head having two or three common liquid chambers. Also, the ink flow passages communicating to the common liquid chamber may be the combination of ink flow passages having different array pitches or the combination of ink flow passages with the same array pitch but with different volumes of ink discharge droplets.

While in each of the above examples, a hole was opened at the top end of dummy nozzle (on the orifice plate side), it is to be noted that a through-hole is not necessarily provided, when the air within the dummy nozzle can be exhausted outside such as the case where there is a clearance (about 5 to 10 μm) between the orifice plate and the end face of the substrate.

While the grooved member in the above examples takes the form of supplying the inks of four colors including black, it will be appreciated that the grooved member may have three liquid chambers integrally formed to supply the inks of three colors excluding black.

<EXAMPLE 21>

Subsequently, a constitutional example of a color ink jet recording apparatus of which an ink jet recording head as constituted in each of the above-described examples is constructed as a cartridge containing an ink tank, and which performs the recording with such ink jet head cartridge IJC (ink jet unit) mounted on the carriage will be described below with reference to FIGS. 34 to 36.

Figure 34:
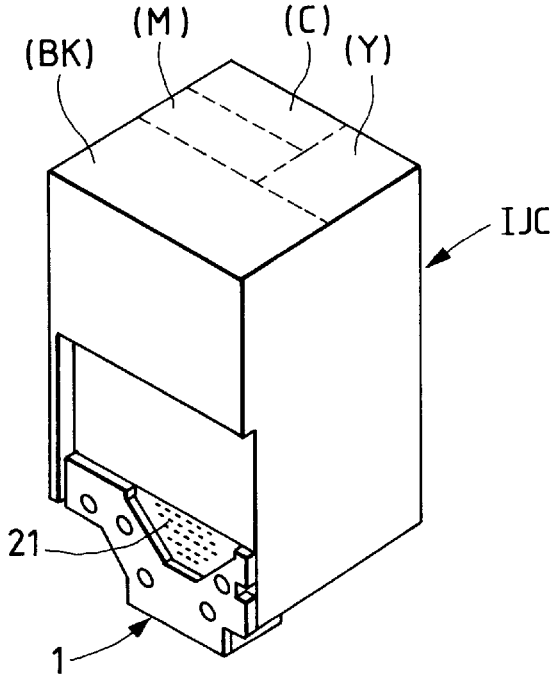
FIG. 34 is a view for explaining an ink jet unit of the invention.
Figure 35:
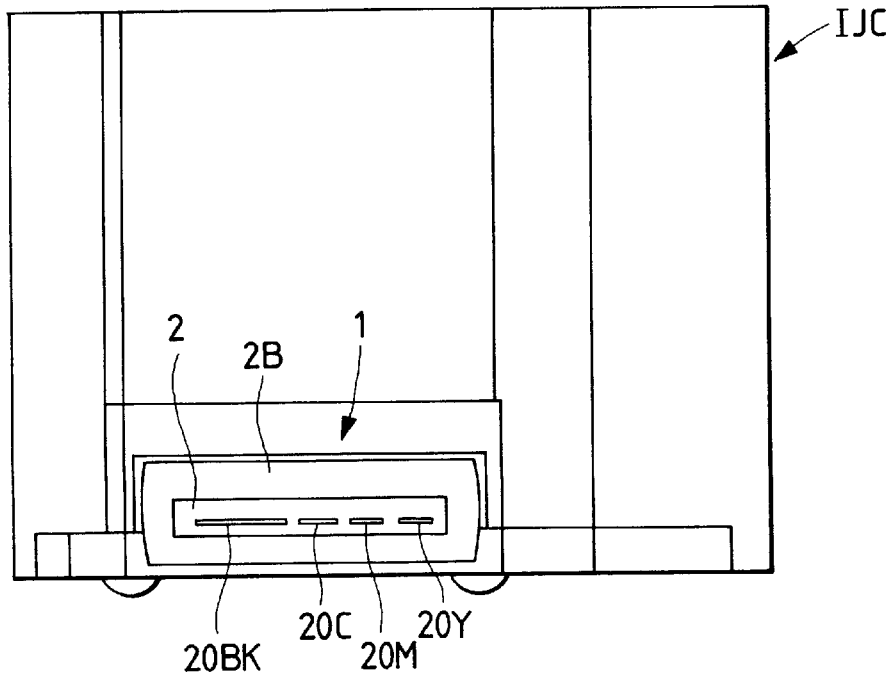
FIG. 35 is a view for explaining the ink jet unit of the invention.

FIGS. 34 and 35 show an example of an ink jet head cartridge IJC (ink jet unit) capable of recording the monochrome or color image. An ink tank receiving portion of the head cartridge IJC has an ink tank divided by color into sections of black (BK), cyan (C), magenta (M) and yellow (Y), as shown by the broken line in FIG. 6, an orifice plate 2 of the recording head 1 exposed on the face of the head cartridge IJC opposite the recording sheet, as shown in FIG. 7. 20BK, 20C, 20M and 20Y are blocks of ink discharge ports which are able to discharge the inks of black (BK), cyan (C), magenta (M) and yellow (Y), and are opened into the orifice plate 2, and a portion 2B indicated by the slanting line around the periphery of the orifice plate 2 is an area to enclose with a cap member at the home position during the recording stand-by or the recovery operation. As shown in FIG. 34, 21 is a terminal portion for feeding an electric power and a recording signal to the recording head portion 1, this terminal portion being electrically connected to the corresponding terminal portion on the carriage, e.g., a flexible wiring board, as will be described later.

Figure 36:
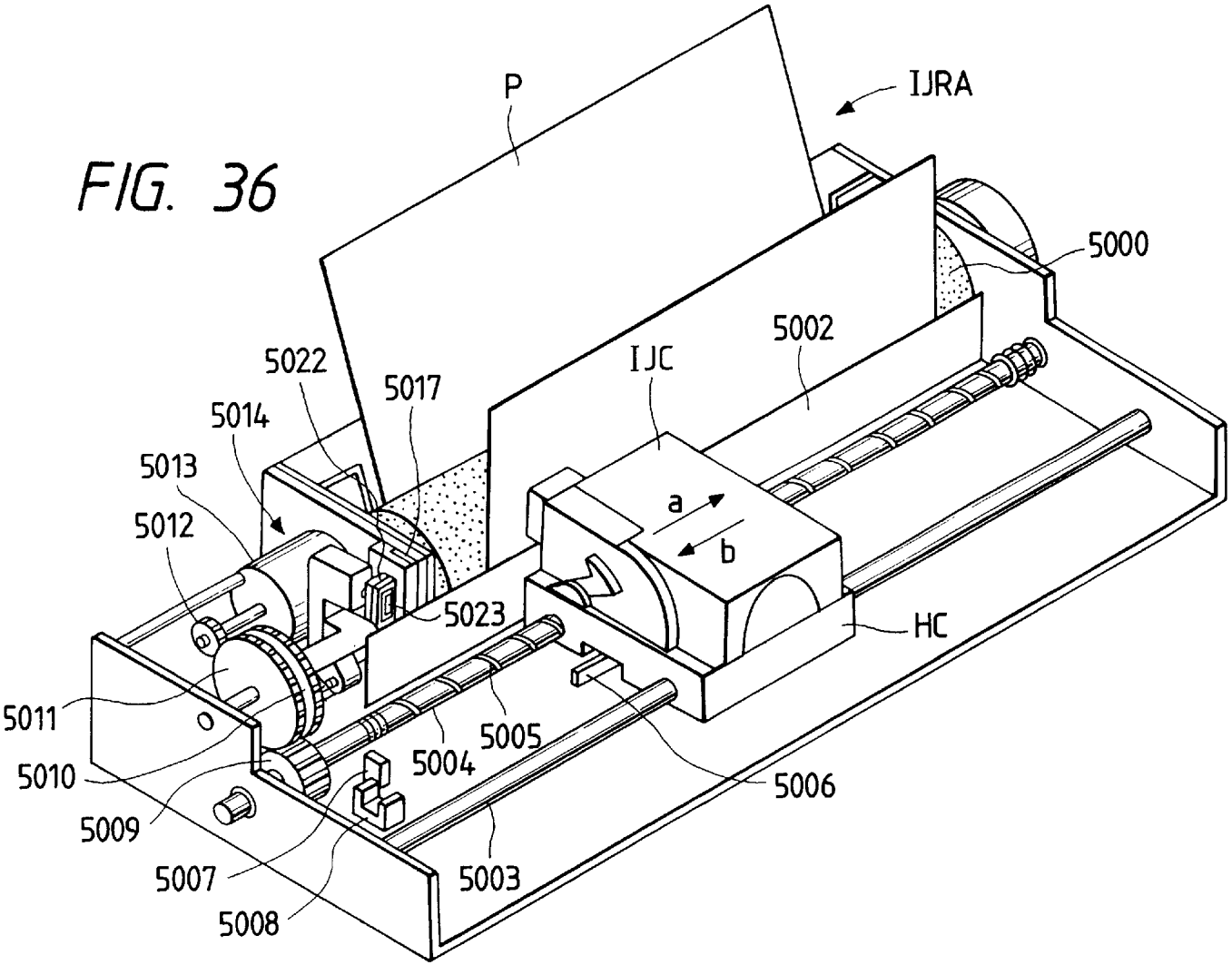
FIG. 36 is a view for explaining an ink jet apparatus of the invention.
Figure 37:
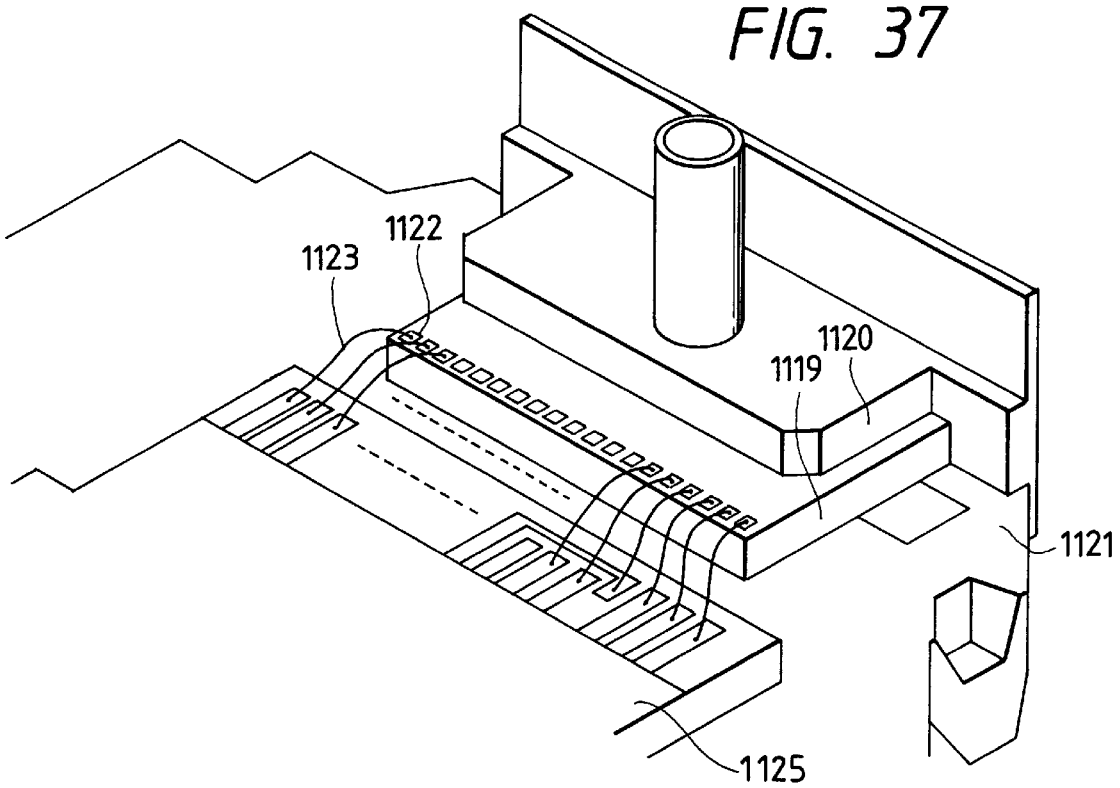
FIG. 37 is a view of an ink jet head of the background art as viewed from the back side.
Figure 38:
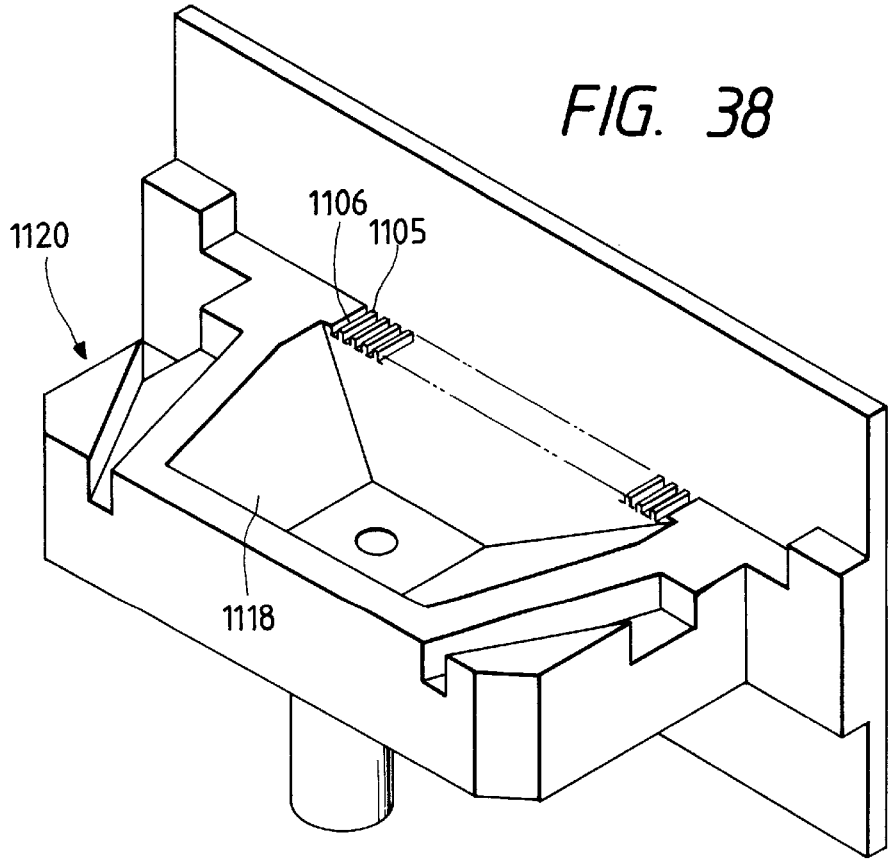
FIG. 38 is a view showing a grooved ceiling plate of the background art.
Figure 39:
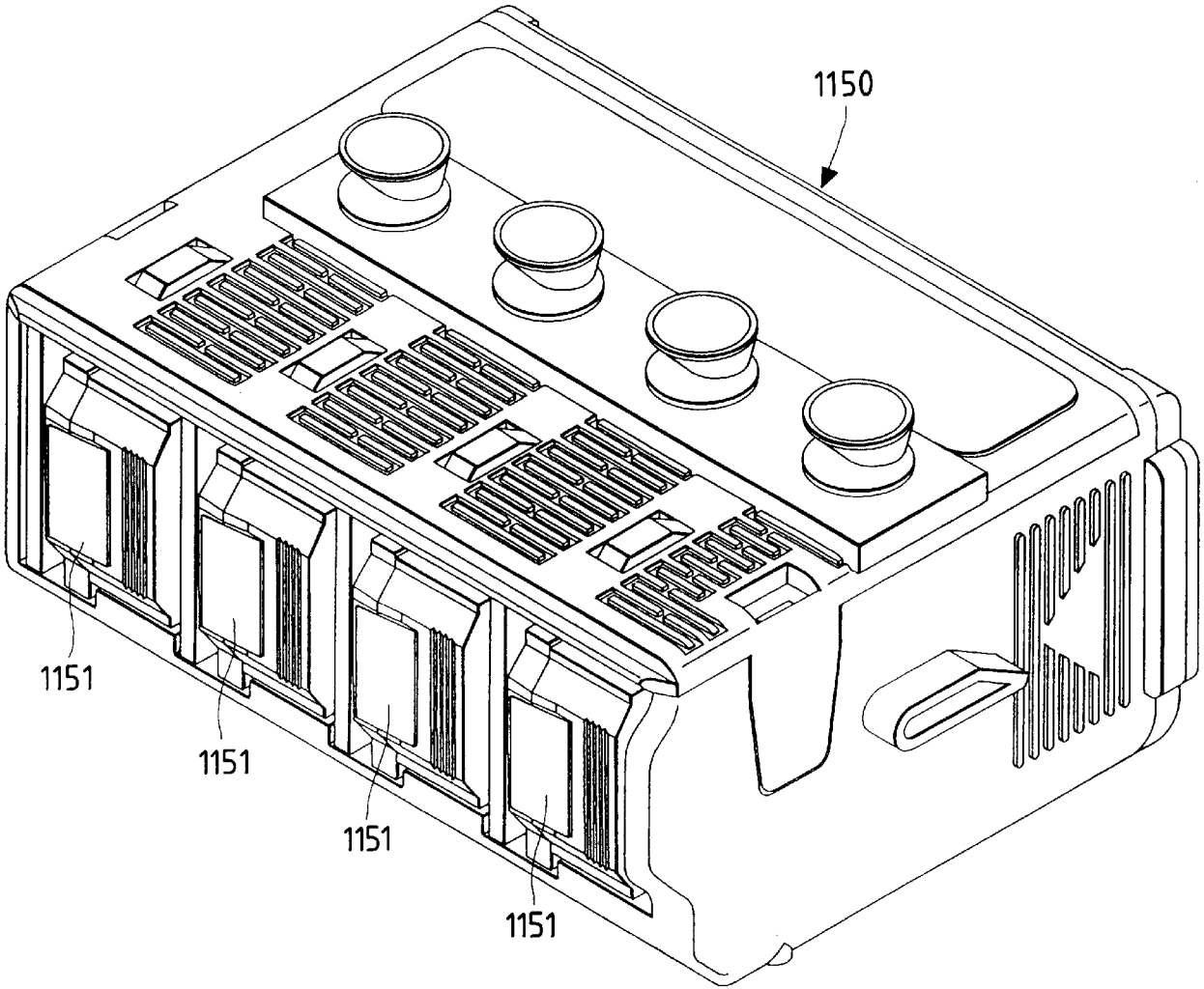
FIG. 39 is a view showing an ink jet head of the background art.

FIG. 36 shows the schematic constitution of an ink jet recording apparatus IJRA which is capable of the color and monochrome recording, with the above head cartridge IJC mounted on the carriage HC. Herein, 5000 is a platen for holding the recording sheet P against a presser plate 5002, wherein the head cartridge IJC mounted on the carriage HC is moved in the directions of the arrows a and b along a guide shaft 5003, and performs the recording by discharging the ink of each color or kind toward the recording sheet P while moving in the both directions or a direction of the arrow a. 5004 is a lead screw for driving the carriage HC by engaging a part of the carriage HC, 5005 is a thread provided on the lead screw 5004, and 5006 is a home position detecting lever extended from the carriage HC. For this detecting lever 5006, photo-couplers 5007, 5008 are provided at the home position. 5009 is a lead screw driving gear, 5010, 5011, 5012 are a gear train which can transmit the driving force of a driving motor 5013 by switching it to the side of recovery mechanism 5014 or lead screw 5004, 5017 is a cleaning blade, 5022 is a cap member, and 5023 is an opening portion. Also, this apparatus has drive signal supply means for supplying a drive signal to the recording head.

The recording operation of the ink jet recording apparatus IJRA with such constitution, as well as the capping, cleaning, and suction recovery operation, are not different from the previously known operations, and are not described here.

What is claimed is:

1. An ink jet head for performing recording by discharging a plurality of inks from respective discharge ports communicating with respective ink flow passages communicating with respective ink chambers for supplying the plurality of inks to said ink flow passages, comprising:

an element substrate provided with a plurality of discharge energy generating elements for generating discharge energy to discharge the plurality of inks; and a grooved member integrally having discharge ports, a plurality of grooves constituting said ink flow passages provided corresponding to said discharge energy generating elements, a plurality of recess portions constituting said liquid chambers for supplying the plurality of inks to said ink flow passages, and at least one separation groove constituting a separation passage provided between said plurality of grooves and between the plurality of recess portions so as to separate said recess portions constituting said liquid chambers, said at least one separation groove being defined by a wall, and being filled with a sealant introduced from one side of said separation passage to another side of said separation passage and having an inner face, said ink flow passages, said ink chambers and said separation passage being formed by effecting direct contact between said element substrate and said grooved member being joined together by applying pressure over the plurality of grooves, the recess portions and the separation groove being inside, such that a contact portion of the wall defining said at least one separation groove contacts a surface of said substrate;

wherein said liquid chambers are separated by said at least one separation groove so as to prevent the plurality of inks from flowing between the liquid chambers and each of said liquid chambers is supplied with a different ink of said plurality of inks.

2. An ink jet recording head according to claim 1, wherein said at least one separation groove comprises a liquid chamber separation groove for separating between said liquid chambers and an ink flow passage separation groove for separating between groups of said ink flow passages communicating with respective liquid chambers.

3. An ink jet recording head according to claim 1, wherein said grooved member comprises a discharge port face formed with said discharge ports, and at least one opening in communication with said at least one separation groove is formed in said discharge port face.

4. An ink jet recording head according to claim 3, wherein said at least one separation groove is wider, at a location opposite said opening of said at least one separation groove, than said at least one opening of said grooved member.

5. An ink jet head for performing recording by discharging a plurality of inks from respective discharge ports communicating with respective ink flow passages communicating with respective ink chambers for supplying the plurality of inks to said ink flow passages, comprising:

an element substrate provided with a plurality of discharge energy generating elements for generating discharge energy to discharge the plurality of inks;

a grooved member integrally having a plurality of grooves constituting said ink flow passages, a plurality of recess portions constituting said ink chambers, and at least one separation groove constituting a separation passage provided between said plurality of grooves and between said plurality of recess portions, wherein said ink flow passages, said ink chambers and said separation passage are formed by effecting direct contact between said element substrate and said grooved member by applying pressure over said plurality of grooves, said Plurality of recess portions and said at least one separation groove inside, respective said ink flow passages and respective said ink chambers for respective inks being separated by introducing a sealant into said separation passage.

6. An ink jet recording head according to claim 5, wherein said sealant comprises a hygroscopic curable resin.

7. An ink jet recording head according to claim 5, wherein said sealant comprises a silicone resin.

8. An ink jet recording head according to claim 1 or wherein three of said liquid chambers are provided.

9. An ink jet recording head according to claim 8, wherein said liquid chambers are supplied with the inks of cyan, magenta and yellow.

10. An ink jet recording head according to claim 1 or 5, wherein four of said liquid chambers are provided.

11. An ink jet recording head according to claim 10, wherein said liquid chambers are supplied with the inks of black, cyan, magenta and yellow.

12. An ink jet recording head according to claim 11, wherein a volume of one of said liquid chambers corresponding to black ink is greater than any one volume of other liquid chambers of said liquid chambers.

13. An ink jet recording head according to claim 1 or 5, wherein a distance between said liquid chambers is equal to an integer number of times of a pitch of an array of said ink flow passages.

14. An ink jet recording head according to claim 1 or 5, wherein a pool for sealant is provided on opposite sides of said at least one separation groove.

15. An ink jet recording head according to claim 1, wherein the wettability of the inner face of said separation groove is greater than a contact portion of the wall constituting said separation groove with said substrate and the surface of said substrate in contact with said contact portion.

16. An ink jet recording head according to claim 1 or 5, wherein each of said plurality of discharge energy generating elements comprises an electrothermal converter.

17. An ink jet unit for performing recording by discharging a plurality of inks, comprising:

an ink jet head for performing recording by discharging said inks from respective discharge ports communicating with respective ink flow passages communicating with respective ink chambers for supplying the plurality of inks to said ink flow passages, comprising:

an element substrate provided with a plurality of discharge energy generating elements for generating discharge energy to discharge the plurality of inks, and a grooved member integrally having discharge ports, a plurality of grooves constituting said ink flow passages, a plurality of recess portions constituting said liquid chambers, and at least one separation groove constituting a separation passage provided between said plurality of grooves and between said plurality of recess portions, wherein said ink flow passages, said ink chambers and said separation passage are formed by effecting direct contact between said element substrate and said grooved member by applying pressure over said plurality of grooves, said plurality of recess portions and said separation groove inside, respective said ink flow passages and respective said ink chambers for respective inks being separated by introducing a sealant into said separation passage; and an ink tank in fluid communication with said ink jet head for storing and supplying the inks to said ink jet head.

18. An ink jet recording apparatus for performing recording by discharging a plurality of inks, comprising:

an ink jet head mounted on said ink jet recording apparatus for performing recording by discharging said inks from respective discharge ports communicating with respective ink flow passages communicating with respective ink chambers for supplying the plurality of inks to said ink flow passages onto a recording medium, comprising:

an element substrate provided with a plurality of discharge energy generating elements for generating discharge energy to discharge the plurality of inks, and a grooved member integrally having discharge ports, a plurality of grooves constituting said ink flow passages provided corresponding to said discharge energy generating elements, a plurality of recess portions constituting said liquid chambers for supplying the plurality of inks to said ink flow passages, and at least one separation groove constituting a separation passage provided between said plurality of grooves and between said plurality of recess portions, wherein said ink flow passages, said ink chambers and said separation passage are formed by effecting direct contact between said element substrate and said grooved member by applying pressure over said plurality of grooves, said plurality of recess portions and said separation groove inside, respective said ink flow passages and respective said ink chambers for respective inks being separated by introducing a sealant into said separation passage; and conveying means mounted on said ink jet recording apparatus for conveying the recording medium to a position adjacent to said ink let head for accepting the inks discharged from said ink jet head.

19. An ink jet recording apparatus for performing recording by discharging a plurality of inks, comprising:

an ink jet head for performing recording by discharging said plurality of inks from respective discharge ports communicating with respective ink flow passages communicating with respective ink chambers for supplying the plurality of inks to said ink flow passages, comprising:

an element substrate provided with a plurality of discharge energy generating elements for generating discharge energy to discharge the plurality of inks, and a grooved member integrally having discharge ports, a plurality of grooves constituting said ink flow passages, a plurality of recess portions constituting said liquid chambers, and at least one separation groove provided between the plurality of recess portions so as to separate said recess portions constituting said liquid chambers, said at least one separation groove being filled with a sealant, said element substrate and said groove member being joined together, wherein said liquid chambers are separated by said at least one separation groove so as to prevent the plurality of inks from flowing between the liquid chambers and each of said liquid chambers is supplied with a different ink of said plurality of inks, said at least one separation groove constituting a separation passage provided between said plurality of grooves and between said plurality of recess portions, wherein said ink flow passages, said ink chambers and said separation passage are formed by effecting direct contact between said element substrate and said grooved member by applying pressure over said plurality of grooves, said plurality of recess portions and said separation groove inside, respective said ink flow passages and respective said ink chambers for respective inks are separated by the sealant introduced into said separation passage; and drive signal supply means for supplying a drive signal to said ink jet head.

20. An ink jet unit for performing recording by discharging a plurality of inks from respective discharge ports communicating with respective ink flow passages communicating with respective ink chambers for supplying the plurality of inks to said ink flow passages, comprising:

an ink jet head for performing recording by discharging said plurality of inks, comprising:

an element substrate provided with a plurality of discharge energy generating elements for generating discharge energy to discharge the plurality of inks, a plurality of liquid chambers provided on said element substrate, and a plurality of groups of ink flow passages corresponding to and communicating with respective said liquid chambers, and at least one ink flow passage separation groove constituting a separation passage for preventing the inks from flowing between adjacent said liquid chambers and said groups of ink flow passages, said at least one separation groove being filled with a sealant introduced from one side of said separation passage to another side of said separation passage, said ink flow passages, said ink chambers and said separation passage being formed by effecting direct contact between said element substrate and said grooved member by applying pressure over said plurality of grooves, said Plurality of recess portions and said separation groove inside, respective said ink flow passages and respective said ink chambers for respective inks being separated by the sealant introduced into said separation passage, wherein each of said plurality of liquid chambers is supplied with a different ink of said plurality of inks; and an ink tank in fluid communication with said ink jet head for storing and supplying the inks to said ink jet head.

21. An ink jet recording apparatus for performing recording by discharging a plurality of inks from respective discharge ports communicating with respective ink flow passages communicating with respective ink chambers for supplying the plurality of inks to said ink flow passages, comprising:

an ink jet head mounted on said ink jet recording apparatus for performing recording by discharging said plurality of inks onto a recording medium, comprising:

an element substrate provided with a plurality of discharge energy generating elements for generating discharge energy to discharge the plurality of inks, a plurality of liquid chambers provided on said element substrate, and a plurality of groups of ink flow passages corresponding to and communicating with respective said liquid chambers, and at least one ink flow passage separation groove constituting a separation passage for preventing the inks from flowing between adjacent said liquid chambers and said groups of ink flow passages, said ink flow passages, said ink chambers and said separation passage being formed by effecting direct contact between said element substrate and said grooved member by applying pressure over said plurality of grooves, said plurality of recess portions and said separation groove inside, respective said ink flow passages and respective said ink chambers for respective inks being separated by introducing a sealant into said separation passage, said at least one separation groove being filled with a sealant introduced from one side of said separation passage to another side of said separation passage, wherein each of said plurality of liquid chambers is supplied with a different ink of said plurality of inks; and conveying means mounted on said ink jet recording apparatus for conveying the recording medium to a position adjacent to said ink jet head for accepting the inks discharged from said ink jet head.

22. An ink jet recording apparatus for performing recording by discharging a plurality of inks from respective discharge ports communicating with respective ink flow passages communicating with respective ink chambers for supplying the plurality of inks to said ink flow passages, comprising:

an ink jet head for performing recording by discharging said plurality of inks, comprising:

an element substrate provided with a plurality of discharge energy generating elements for generating discharge energy to discharge the plurality of inks, a plurality of liquid chambers provided on said element substrate, and a plurality of groups of ink flow passages corresponding to and communicating with respective said liquid chambers, and at least one ink flow passage separation groove constituting a separation passage for preventing the inks from flowing between adjacent said liquid chambers and said groups of ink flow passages, said ink flow passages, said ink chambers and said separation passage being formed by effecting direct contact between said element substrate and said grooved member by applying pressure over said plurality of grooves, said plurality of recess portions and said separation groove inside, respective said ink flow passages and respective said ink chambers for respective inks being separated by introducing a sealant into said separation passage, said at least one separation groove being filled with the sealant introduced from one side of said separation passage to another side of said separation passage, wherein each of said plurality of liquid chambers is supplied with a different ink of said plurality of inks; and drive signal supply means for supplying a drive signal to said ink jet head, said drive signal supply means being in electrical communication with said ink jet head.

23. An ink jet head according to claim 5, wherein a connecting ortion for applying a signal for driving said discharge energy generating elements is provided on a rear end of said element substrate and a rear end of said grooved member disposed at said rear end of said substrate has such a shape that the rear end of said grooved member does not interfere with said connecting portion of said element substrate, a sealant having been injected into said separation passage from a top of said rear end of said grooved member.

24. An ink jet head according to claim 23, wherein said connecting portion includes a plurality of bonding wires and a sealant coating said plurality of bonding wires.

25. An ink jet head according to claim 23, further comprising a guide groove for guiding the sealant from said rear end of said grooved member to said separation passage.

26. An ink jet head according to claim 25, further comprising means for limiting an injection area of the sealant from said rear end of said grooved member.

27. An ink jet head according to claim 26, wherein the sealant is guided to said guide groove through the injection area of the sealant limited by said means for limiting.

28. An ink jet head according to claim 5, wherein said separation passage provided between said plurality of grooves is a dummy nozzle.

29. An ink jet head according to claim 5 or 28, wherein said separation passage comprises a passage provided between said plurality of grooves and a separation passage provided between said plurality of recess portion which have continuous ceiling surfaces which have a substantially equal height.

30. An ink jet head according to claim 5, or 28, wherein a difference in a height, a width and a cross-sectional area between said passage provided between said plurality of grooves and said passage provided between said plurality of recess portions is not more than 20%.

31. An ink jet head according to claim 29, wherein said passage provided between said plurality of recess portions has a cross-sectional area smaller than a cross-sectional area of said passage provided between said plurality of grooves.

32. An ink jet head according to claim 29, wherein a gap of not less than 10$\mu$m is provided between said plurality of recess portions and said passage provided between said plurality of grooves.

33. An ink jet head according to claim 28, further comprising an orifice plate having a penetrating hole communicating with said passage provided between said plurality of grooves and a groove communicating with said penetrating hole.

34. An ink jet head according to claim 28, wherein said dummy nozzle is formed by an excimer laser.

35. An ink jet head according to claim 28, wherein said grooved member is formed by injection molding.

* * * * *

UNITED STATES PATENT AND TRADEMARK OFFICE

CERTIFICATE OF CORRECTION

PATENT NO. : 6,155,677
DATED : December 5, 2000
INVENTOR(S) : Masashi Kitani et al.

It is certified that error appears in the above-identified patent and that said Letters Patent is hereby corrected as shown below:

Title page,
Item [56] References Cited , U.S. PATENT DOCUMENTS "4,666,823 6/1985 Yokota et al." should read -- 4,666,823 5/1987 Yokota et al. --.
Item [57] ABSTRACT, line 10, "between" should be deleted; and
Line 12, "being jointed" should read -- are joined --.

Column 1,
Lines 29 and 31, "looked" should read -- viewed --;
Line 50, "1is" should read -- is --.

Column 5,
Line 3, "such as" should read -- with --.

Column 8,
Line 23, "is" should be deleted.

Column 10,
Line 56, "less amount" should read -- little --;
Line 58, "amount of" should be deleted.

Column 24,
Line 54, "Plurality" should read -- plurality --; and
Line 63, "1 or" should read -- 1 or 5, --.

Column 25,
Line 17, "the" (first occurrence) should be deleted; and "said" should read -- said at least one --;
Line 18, "than a" should read -- than wettability of the --; and "consti-" should read -- defining --; and
Line 19, "tuting" should be deleted.

Column 26,
Line 21, "let" should read -- jet --.

UNITED STATES PATENT AND TRADEMARK OFFICE

CERTIFICATE OF CORRECTION

PATENT NO. : 6,155,677
DATED : December 5, 2000
INVENTOR(S) : Masashi Kitani et al.

It is certified that error appears in the above-identified patent and that said Letters Patent is hereby corrected as shown below:

Column 28,
Line 45, "ortion" should read -- portion --.

Column 29,
Line 4, "portion" should read -- portions --.

Signed and Sealed this

Twenty-eighth Day of May, 2002

*Attest:*

*Attesting Officer*

JAMES E. ROGAN
*Director of the United States Patent and Trademark Office*